US007692088B2

(12) United States Patent
Umeyama et al.

(10) Patent No.: US 7,692,088 B2
(45) Date of Patent: Apr. 6, 2010

(54) MUSICAL SOUND WAVEFORM SYNTHESIZER

(75) Inventors: Yasuyuki Umeyama, Hamamatsu (JP); Eiji Akazawa, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 11/453,577

(22) Filed: Jun. 14, 2006

(65) Prior Publication Data

US 2006/0283309 A1 Dec. 21, 2006

(30) Foreign Application Priority Data

Jun. 17, 2005 (JP) ..... 2005-177859
Jun. 17, 2005 (JP) ..... 2005-177860

(51) Int. Cl.
*G10H 1/22* (2006.01)
*G10H 1/02* (2006.01)
*G10H 7/00* (2006.01)

(52) U.S. Cl. ..... 84/627; 84/609; 84/618; 84/622; 84/628; 84/645

(58) Field of Classification Search ..... 84/626, 84/627, 662, 663, 701, 702, 737, 738, 609, 84/649, 618, 656, 684, 622, 659, 692, 703, 84/628, 704, 645
See application file for complete search history.

(56) References Cited

U.S. PATENT DOCUMENTS 3,610,806 A * 10/1971 Deutsch ..... 84/663
3,808,344 A * 4/1974 Ippolito et al. ..... 84/676
4,166,405 A * 9/1979 Hiyoshi et al. ..... 84/627
4,240,318 A * 12/1980 Gross ..... 84/648
4,524,668 A * 6/1985 Tomisawa et al. ..... 84/627
4,558,624 A * 12/1985 Tomisawa et al. ..... 84/626
4,694,723 A * 9/1987 Shinohara et al. ..... 84/609
4,726,276 A * 2/1988 Katoh et al. ..... 84/663

(Continued)

FOREIGN PATENT DOCUMENTS

JP 2003-271142 A 9/2003

OTHER PUBLICATIONS

Notification of Reasons for Refusal mailed Jul. 28, 2009, for JP Patent Application No. 2005-177859, with English translation, seven pages.

(Continued)

*Primary Examiner*—Jeffrey Donels
*Assistant Examiner*—Andrew R Millikin
(74) *Attorney, Agent, or Firm*—Morrison & Foerster LLP

(57) ABSTRACT

The present invention is directed to a waveform synthesizer apparatus that synthesizes a waveform of a musical sound based on musical performance event information. In particular, a music synthesizer includes an overlap detector that detects whether a first and second musical sound overlap, and a sound length meter that determines a sound length of the first musical sound. If the first and second musical sounds overlap, the synthesizer instantly terminates synthesizing of the first sound and starts synthesizing the second sound, provided the length of the first sound does not exceed a predetermined length. If the first and second sounds do not overlap, synthesis of the first sound is terminated, and the synthesis of the second sound is initiated, if it is determined that the length of rest between the two sounds does not exceed a predetermined length, and that the first sound does not exceed a predetermined length.

10 Claims, 19 Drawing Sheets

U.S. PATENT DOCUMENTS 5,018,430 A * 5/1991 Iijima et al. ..... 84/625
5,069,105 A * 12/1991 Iba et al. ..... 84/605
5,086,685 A * 2/1992 Hanzawa et al. ..... 84/605
5,123,322 A * 6/1992 Hanzawa et al. ..... 84/605
5,167,179 A * 12/1992 Yamauchi et al. ..... 84/618
5,185,491 A * 2/1993 Izumisawa et al. ..... 84/627
5,216,189 A * 6/1993 Kato ..... 84/662
5,218,158 A * 6/1993 Kimura ..... 84/663
5,239,123 A * 8/1993 Fujita ..... 84/605
5,286,916 A * 2/1994 Yamauchi ..... 84/661
5,324,882 A * 6/1994 Ohta et al. ..... 84/604
5,403,971 A * 4/1995 Aoki ..... 84/626
5,422,431 A * 6/1995 Ichiki ..... 84/663
5,610,353 A * 3/1997 Hagino ..... 84/604
5,687,240 A * 11/1997 Yoshida et al. ..... 381/61
5,905,223 A * 5/1999 Goldstein ..... 84/649
5,990,404 A * 11/1999 Miyano ..... 84/609
5,998,725 A * 12/1999 Ohta ..... 84/627
6,066,793 A * 5/2000 Ogai et al. ..... 84/615
6,091,013 A * 7/2000 Waller et al. ..... 84/663
6,121,532 A * 9/2000 Kay ..... 84/611
6,121,533 A * 9/2000 Kay ..... 84/616
6,150,598 A * 11/2000 Suzuki et al. ..... 84/603
6,255,576 B1 * 7/2001 Suzuki et al. ..... 84/604
6,281,423 B1 8/2001 Shimizu
6,284,964 B1 * 9/2001 Suzuki et al. ..... 84/626
6,362,409 B1 * 3/2002 Gadre ..... 84/603
6,365,818 B1 * 4/2002 Suzuki ..... 84/604
6,407,326 B1 * 6/2002 Kondo ..... 84/615
6,531,652 B1 * 3/2003 Suzuki et al. ..... 84/626
6,576,827 B2 * 6/2003 Tamura ..... 84/622
6,639,141 B2 * 10/2003 Kay ..... 84/609
6,687,674 B2 * 2/2004 Suzuki et al. ..... 704/268
6,727,420 B2 * 4/2004 Suzuki et al. ..... 84/604
6,873,955 B1 * 3/2005 Suzuki et al. ..... 704/503
6,881,888 B2 * 4/2005 Akazawa et al. ..... 84/604
6,911,591 B2 * 6/2005 Akazawa et al. ..... 84/616
7,099,827 B1 * 8/2006 Tamura ..... 704/270
7,187,844 B1 * 3/2007 Terao et al. ..... 386/56
7,249,022 B2 * 7/2007 Kayama et al. ..... 704/267
7,259,315 B2 * 8/2007 Tamura et al. ..... 84/627
7,271,330 B2 * 9/2007 Akazawa et al. ..... 84/626
2002/0152877 A1 * 10/2002 Kay ..... 84/609
2002/0178006 A1 * 11/2002 Suzuki et al. ..... 704/258
2003/0050781 A1 * 3/2003 Tamura et al. ..... 704/267
2003/0154847 A1 * 8/2003 Akazawa et al. ..... 84/627
2003/0177892 A1 * 9/2003 Akazawa et al. ..... 84/616
2004/0099125 A1 * 5/2004 Kay ..... 84/609
2005/0081700 A1 * 4/2005 Kikumoto ..... 84/604
2006/0054006 A1 * 3/2006 Akazawa ..... 84/609
2006/0213356 A1 * 9/2006 Nakazono et al. ..... 84/645
2006/0272482 A1 * 12/2006 Tamura et al. ..... 84/604

OTHER PUBLICATIONS

Notification of Reasons for Refusal mailed Jul. 28, 2009, for JP Patent Application No. 2005-177860, with English translation, 10 pages.

* cited by examiner

MUSICAL SOUND WAVEFORM SYNTHESIZER

BACKGROUND OF THE INVENTION

1. Technical Field of the Invention

The present invention relates to a musical sound waveform synthesizer for synthesizing musical sound waveforms.

2. Description of the Related Art

A musical sound waveform can be divided into different sections by characteristics, including a start waveform, a sustain waveform, and an end waveform. A musical sound waveform produced by playing a performance such as legato, which smoothly joins together two musical sounds, includes a connection waveform where a transition is made between the pitches of the two musical sounds.

In a known musical sound waveform synthesizer, a plurality of types of waveform data parts of musical sound waveforms, including start waveform parts (heads), sustain waveform parts (bodies), end waveform parts (tails), and connection waveform parts (joints) of musical sound waveforms (with each of the connection waveform parts representing a transition part between the pitches of two musical sounds) are stored in a storage, and appropriate waveform data parts are read from the storage based on performance event information, and the read waveform data parts are then joined together, thereby synthesizing a musical sound waveform. In this musical sound waveform synthesizer, an articulation is identified based on performance event information, and a musical sound waveform representing the characteristics of the identified articulation is synthesized along a playback time axis by combining waveform parts corresponding to the articulation, which include a start waveform part (head), a sustain waveform part (body), an end waveform part (tail), and a connection waveform part (joint), representing a pitch transition between the pitches of two musical sounds, so that the waveform parts are arranged along the time axis. Such a method is disclosed in Japanese Unexamined Patent Application Publication No. 2001-92463 (corresponding U.S. Pat. No. 6,284,964) and Japanese Unexamined Patent Application Publication No. 2003-271139 (corresponding US patent application publication No. 2003/0177892).

The fundamentals of musical sound synthesis of a conventional musical sound waveform synthesizer will now be described with reference to FIGS. 11 to 13. Parts (a) of FIGS. 11, 12 and 13 (hereafter referred to as FIGS. 11*a*, 12*a*, and 13*a*, respectively) illustrate music scores written in piano roll notation, and parts (b) of FIGS. 11, 12 and 13 (hereafter likewise referred to as FIGS. 11*b*, 12*b*, and 13*b*, respectively) illustrate musical sound waveforms synthesized when the music scores are played.

When a music score shown in FIG. 11*a* is played, a note-on event of a musical sound 200 occurs at time "t1" and is then received by the musical sound waveform synthesizer. Accordingly, the synthesizer starts synthesizing a musical sound waveform of the musical sound 200 from its start waveform part (head) at time "t1" as shown in FIG. 11*b*. Upon completing the synthesis of the head, the musical sound waveform synthesizer still proceeds to synthesize the musical sound waveform while transitioning it from the head to a sustain waveform part (body), since at this time the synthesizer has not received any note-off event, as shown in FIG. 11*b*. Upon receiving a note-off event at time "t2", the synthesizer synthesizes the musical sound waveform while transitioning it from the body to an end waveform part (tail). Upon completing the synthesis of the tail, the musical sound waveform synthesizer completes the synthesis of the musical sound waveform of the musical sound 200. In this manner, the synthesizer synthesizes the musical sound waveform of the musical sound 200 by sequentially arranging, as shown in FIG. 11*b*, the head, the body, and the tail along the time axis, starting from the time "t1" at which it has received the note-on event.

As shown in FIG. 11*b*, the head is a partial waveform including a one-shot waveform 100 representing an attack and a loop waveform 101 connected to the tail end of the one-shot waveform 100 and corresponds to a rising edge of the musical sound waveform. The body is a partial waveform including a plurality of sequentially connected loop waveforms 102, 103, . . . , and 107 having different tone colors and corresponds to a sustain part of the musical sound waveform of the musical sound. The tail is a partial waveform including a one-shot waveform 109 representing a release and a loop waveform 108 connected to the head end of the one-shot waveform 109 and corresponds to a falling edge of the musical sound waveform. Adjacent loop waveforms are connected through cross-fading so that the musical sound is synthesized while transitioning between partial or loop waveforms.

For example, the loop waveform 101 and the loop waveform 102 are adjusted to be in phase and are then connected through cross-fading, thereby smoothly joining together the two waveform parts (i.e., the head and the body) while transitioning the musical sound waveform from the head to the body. In addition, the loop waveform 102 and the loop waveform 103 are adjusted to be in phase and are then connected through cross-fading while changing the tone color from a tone color of the loop waveform 102 to a tone color of the loop waveform 103 in the body. In this manner, adjacent ones of the plurality of loop waveforms 102 to 107 in the body are connected through cross-fading so that vibrato or a tone color change corresponding to a pitch change with time is given to the musical sound. Further, the loop waveform 107 and the loop waveform 108 are adjusted to be in phase and are then connected through cross-fading, thereby smoothly joining together the two waveform parts (i.e., the body and the tail) while transitioning the musical sound waveform from the body to the tail. Since the body is synthesized by connecting the plurality of loop waveforms 102 to 107 through cross-fading, it is possible to transition from any position of the body to the tail or the like. As the main waveform of each of the head and the tail is a one-shot waveform, it is not possible to transition from each of the head and the tail to the next waveform part, particularly during real-time synthesis of the head and tail.

FIGS. 12*a* and 12*b* illustrate how a musical sound waveform is synthesized by connecting two musical sounds when a legato is played using a monophonic instrument such as a wind instrument.

When a music score shown in FIG. 12*a* is played, a note-on event of a musical sound 210 occurs at time "t1" and is then received by the musical sound waveform synthesizer. Accordingly, the synthesizer starts synthesizing a musical sound waveform of the musical sound 210 from its head, which includes a one-shot waveform 110, at time "t1" as shown in FIG. 12*b*. Upon completing the synthesis of the head, the synthesizer proceeds to synthesize the musical sound waveform while transitioning it from the head to a body (Body1) since it has not received any note-off event the synthesizer has not received the note-off event, as shown in FIG. 12*b*. When the synthesizer receives a note-on event of a musical sound 211 at time "t2", it determines that a legato performance has been played since it still has not received any note-off event of the musical sound 210, and proceeds to synthesize the musical sound waveform while transitioning it from the body (Body1) to a connection waveform part (Joint) that includes a one-shot waveform 116 representing a pitch transition part from the musical sound 210 to the musical sound 211. At time "t3", the synthesizer receives a note-off event of the musical sound 210. Upon completing the synthesis of the joint, the synthesizer proceeds to synthesize the musical sound waveform while transitioning it from the joint to a body (Body2) since it has not received any note-off event of the musical sound 211. Thereafter, at time "t4", the synthesizer receives a note-off event of the musical sound 211 and proceeds to synthesize the musical sound waveform while transitioning it from the body (Body2) to a tail. The synthesizer then completes the synthesis of the tail, which includes a one-shot waveform 122, thereby completing the synthesis of the musical sound waveform. In this manner, the musical sound waveform synthesizer synthesizes the musical sound waveform of the musical sounds 200 and 211 by sequentially arranging, as shown in FIG. 12*b*, the head (Head), the body (Body1), the joint (Joint), the body (Body2), and the tail (Tail) along the time axis, starting from the time "t1" at which it has received the note-on event. The waveforms are connected in the same manner as the example of FIGS. 11*a* and 11*b*.

FIGS. 13*a* and 13*b* illustrate how a musical sound waveform is synthesized when a short performance is played.

When a music score shown in FIG. 13*a* is played, a note-on event of a musical sound 220 occurs at time "t1" and is then received by the synthesizer. Accordingly, the synthesizer starts synthesizing a musical sound waveform of the musical sound 220 from its head, which includes a one-shot waveform 125 of the musical sound 220, at time "t1" as shown in FIG. 13*b*. At time "t2" before the synthesis of the head is completed, a note-off event of the musical sound 220 occurs and is then received by the musical sound waveform synthesizer. After completing the synthesis of the head, the synthesizer proceeds to synthesize the musical sound waveform while transitioning it from the head to a tail which includes a one-shot waveform 128. Upon completing the synthesis of the tail, the synthesizer completes the synthesis of the musical sound waveform of the musical sound 220. In this manner, when a short performance is played, the synthesizer synthesizes the musical sound waveform of the musical sound 220 by sequentially arranging, as shown in FIG. 13*b*, the head (Head) and the tail (Tail) along the time axis, starting from the time "t1" at which it has received the note-on event.

Synthesizing the tail is normally started from the time when a note-off event is received. However, in FIG. 13*b*, the tail is synthesized later than the time when the note-off event of the musical sound 220 is received, and the length of the synthesized musical sound waveform is greater than that of the musical sound 220. This is because the head is a partial waveform including a one-shot waveform 125 and a loop waveform 126 connected to the tail end of the one-shot waveform 125 and it is not possible to transition to the tail during synthesis of the one-shot waveform 125 as described above with reference to FIG. 11 and because the musical sound waveform is not completed until the one-shot waveform 128 of the tail is completed. Thus, even when it is requested that a sound shorter than the total length of the head and the tail be synthesized, it is not possible to synthesize a musical sound waveform to be shorter than the total length thereof. There is also a certain limitation on the shortness of the actual sound of acoustic instruments. For example, musical sound of a wind instrument cannot be shorter than a certain length since the wind instrument sounds for at least the acoustic response duration of its tube even when it is blown for a short time. Thus, for acoustic instruments, it can also be assumed that it is not possible to synthesize a musical sound waveform shorter than the total length of the head and the tail. Also in the case of FIGS. 12*a* and 12*b* where the legato is played, it is not possible to transition to the next waveform part during synthesis of the waveform of the joint since the joint includes a one-shot waveform. Therefore, when a legato is played, it is not possible to synthesize a musical sound waveform shorter than the total length of the head, the joint, and the tail.

When a legato with two musical sounds is played for a short time using an acoustic instrument through fast playing, a pitch transition must be started from the note-on time of the second of the two musical sounds. However, the conventional musical sound waveform synthesizer has a problem in that its response to the note-on event of the second musical sound is delayed relative to acoustic instruments. As described above, acoustic instruments have an acoustic response duration, which causes a slow (or unclear) transition between pitches rather than a rapid pitch change when a legato is played using an acoustic instrument. However, the acoustic response duration does not delay the start of the pitch transition. Rather, the response of the conventional musical sound waveform synthesizer to the occurrence of an event is delayed so that it synthesizes a longer musical sound waveform from a short sound played through fast playing, mis-touching, or the like. This causes the musical sound to be delayed and generates a self-sustaining sound from mis-touching. The term "mis-touching" refers to an action of a player having a low skill or the like to generate a performance event that causes unintended sound having a short duration. For example, in a keyboard instrument, the mis-touching occurs when an intended key is pressed simultaneously and inadvertently with its neighboring key. In a wind controller, which is a MIDI controller simulating a wind instrument, the short error sound occurs when keys, which must be pressed at the same time to determine the pitches, are pressed at different times or when key and breath operations do not match.

In this case, a mis-touching sound and a subsequent sound are connected through a joint, so that the mis-touching sound is generated for a longer time than actual mis-action and the generation of the subsequent sound, which is a normal performance sound, is delayed. In this manner, playing a music performance pattern results in a delay in the generation of the musical performance, which causes a significant problem in listening to the musical sound and also makes the presence of the mis-touching sound very noticeable.

As described above, the conventional musical sound waveform synthesizer has a problem in that, when a short sound is played through fast playing or mis-touching, the generation of a subsequent sound is delayed.

As noted above, a short sound may be generated by mis-touching. Even when a performance event of a short sound has occurred through mis-touching, the short sound is synthesized into a long musical sound waveform, thereby causing a problem in that the mis-touching sound is self-sustained.

When a legato with two musical sounds is played for a short time using an acoustic instrument through fast playing, a pitch transition must be normally started from the note-on time of the second of the two musical sounds. However, the response of the conventional musical sound waveform synthesizer to the note-on event of the second musical sound is delayed relative to acoustic instruments. As described above, acoustic instruments have an acoustic response duration, which causes a slow (or unclear) transition between pitches rather than a rapid pitch change when a legato is played using an acoustic instrument. However, the acoustic response duration does not delay starting the pitch transition. On the contrary, the response of the conventional musical sound waveform synthesizer to the occurrence of an event is delayed so that it synthesizes a longer musical sound waveform from a short sound. Even when a performance event of a short sound that overlaps a previous sound has occurred through mis-touching, the short sound is synthesized into a long musical sound waveform, thereby causing a problem in that the mis-touching sound is self-sustained.

SUMMARY OF THE INVENTION

Therefore, it is an object of the present invention to provide a musical sound waveform synthesizer wherein, when a short sound is played through fast playing or mis-touching, the generation of a subsequent sound is not delayed.

It is another object of the present invention to provide a musical sound waveform synthesizer wherein, when a short sound is played through mis-touching, the mis-touching sound is not self-sustained.

The most important feature of the musical sound waveform synthesizer provided by the present invention to accomplish the above object is that, when it is detected that a musical sound to be generated overlaps a previous sound, the synthesis of a musical sound waveform of the previous sound is terminated and the synthesis of a musical sound waveform of the musical sound to be generated is initiated if it is determined that the length of the previous sound does not exceed a predetermined sound length.

The other most important feature of the musical sound waveform synthesizer provided by the present invention to accomplish the above object is that, when a note-on event that does not overlap a previous sound is detected, the synthesis of a musical sound waveform of the previous sound is terminated and the synthesis of a musical sound waveform corresponding to the note-on event is initiated if it is determined that the length of a rest between the previous sound and the note-on event does not exceed a predetermined rest length and it is also determined that the length of the previous sound does not exceed a predetermined sound length.

In accordance with a preferred embodiment of the present invention, the synthesis of a musical sound waveform of a previous sound is terminated and the synthesis of a musical sound waveform of a musical sound to be generated is initiated when it is detected that the musical sound to be generated overlaps the previous sound and it is also determined that the length of the previous sound does not exceed a predetermined sound length. Accordingly, when a short sound is played, the generation of a subsequent sound is not delayed.

Further in accordance with another preferred embodiment of the present invention, when a note-on event that does not overlap a previous sound is detected, the synthesis of a musical sound waveform of the previous sound is terminated, and the synthesis of a musical sound waveform corresponding to the note-on event is initiated, if it is determined that the length of a rest between the previous sound and the note-on event does not exceed a predetermined rest length and that the length of the previous sound does not exceed a predetermined sound length. This reduces the length of a musical sound waveform synthesized when a short sound caused by mis-touching is played, thereby preventing the mis-touching sound from being self-sustained.

DETAILED DESCRIPTION OF THE INVENTION

Figure 1:
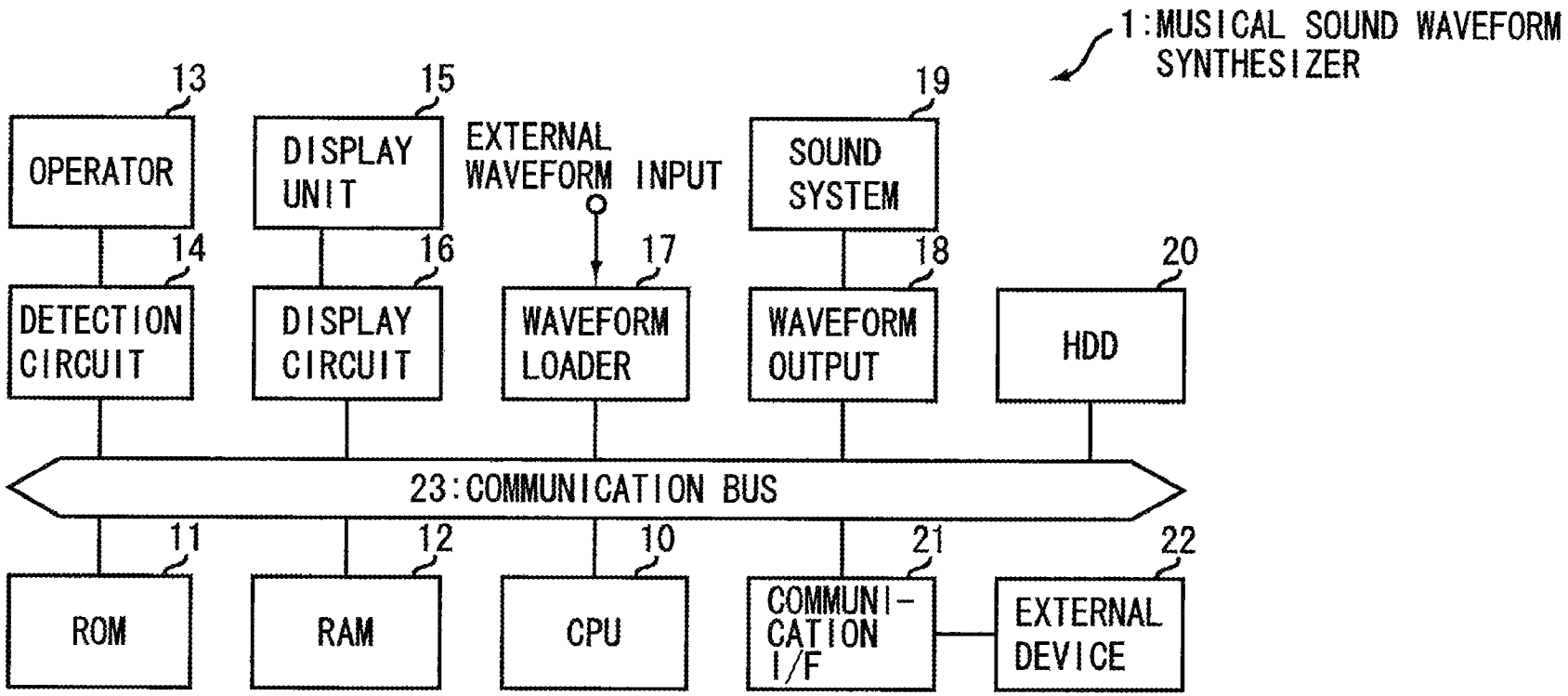
FIG. 1 is a block diagram of an example hardware configuration of a musical sound waveform synthesizer according to an embodiment of the present invention.

FIGS. 14*a* and 15*a* illustrate, inter alia, music scores written in piano roll notation of example patterns of a short sound that is typically generated by mis-touching.

In the pattern shown in FIG. 14*a*, a mis-touching sound 251 occurs between a previous sound 250 and a subsequent sound 252, and the mis-touching sound 251 overlaps both the previous and subsequent sounds 250 and 252. Specifically, a note-on event of the previous sound 250 occurs at time "t1" and a note-off event thereof occurs at time "t3". A note-on event of the mis-touching sound 251 occurs at time "t2" and a note-off event thereof occurs at time "t5". A note-on event of the subsequent sound 252 occurs at time "t4" and a note-off event thereof occurs at time "t6". Accordingly, the mis-touching sound 251 overlaps the previous sound 250, starting from the time "t2", and overlaps the subsequent sound 252, starting from the time "t4".

In the pattern shown in FIG. 15*a*, a mis-touching sound 261 occurs between a previous sound 260 and a subsequent sound 262, and the mis-touching sound 261 does not overlap the previous sound 260 but overlaps the subsequent sound 262. Specifically, a note-on event of the previous sound 260 occurs on at time "t1" and a note-off event thereof occurs at time "t2". A note-on event of the mis-touching sound 261 occurs at time "t3" and a note-off event thereof occurs at time "t5". A note-on event of the subsequent sound 262 occurs at time "t4" and a note-off event thereof occurs at time "t6". Accordingly, the period of the previous sound 260 is terminated before time "t3" at which the note-on event of the mis-touching sound 261 occurs, and the mis-touching sound 261 overlaps the subsequent sound 262, starting from the time "t4".

FIG. 14*b* illustrates how a musical sound is synthesized when the music score shown in FIG. 14*a* is played.

When the music score shown in FIG. 14*a* is played, a note-on event of a previous sound 250 occurs at time "t1" and is then received by the synthesizer. Accordingly, the musical sound waveform synthesizer starts synthesizing a musical sound waveform of the previous sound 250 from a head (Head1) thereof at time "t1" as shown in FIG. 14*b*. Upon completing the synthesis of the head (Head1), the synthesizer proceeds to synthesize the musical sound waveform while transitioning it from the head (Head1) to a body (Body1) since it has not received any note-off event as shown in FIG. 14*b*. When the synthesizer receives a note-on event of a mis-touching sound 251 at time "t2", the musical sound waveform synthesizer determines that the mis-touching sound 251 overlaps the previous sound 250 since it still has not received any note-off event of the previous sound 250, and proceeds to synthesize the musical sound waveform while transitioning it from the body (Body1) to a joint (Joint1) that represents a pitch transition part from the previous sound 250 to the mis-touching sound 251. At time "t3", the synthesizer receives a note-off event of the previous sound 250. Then, the synthesizer receives a note-on event of the subsequent sound 252 at time "t4" before the synthesis of the joint (Joint1) is completed and before it receives a note-off event of the mis-touching sound 251. When the synthesis of the joint (Joint1) is completed, the synthesizer proceeds to synthesize the musical sound waveform while transitioning it from the joint (Joint1) to a joint (Joint2) that represents a pitch transition part from the mis-touching sound 251 to the subsequent sound 252.

Upon completing the synthesis of the joint (Joint2), the musical sound waveform synthesizer proceeds to synthesize the musical sound waveform while transitioning it from the joint (Head2) to a body (Body2) since it has not received any note-off event of the subsequent sound 252 as shown in FIG. 14*b*. Then, at time "t6", the synthesizer receives a note-off event of the subsequent sound 252 and proceeds to synthesize the musical sound waveform while transitioning it from the body (Body2) to a tail (Tail2). The synthesizer then completes the synthesis of the tail (Tail2), thereby completing the synthesis of the musical sound waveform of the previous sound 250, the mis-touching sound 251, and the subsequent sound 252.

In the above manner, the head (Head1) and the body (Body1) of the previous sound 250 are sequentially synthesized, starting from the time "t1" at which the note-on event of the previous sound 250 occurs, and a transition is made from the body (Body1) to the joint (Joint1) at time "t2" at which the note-on event of the mis-touching sound 251 occurs. This joint (Joint1) represents a pitch transition part from the previous sound 250 to the mis-touching sound 251. Subsequently, a transition is made from the joint (Joint1) to the joint (Joint2). This joint (Joint2) represents a pitch transition part from the mis-touching sound 251 to the subsequent sound 252. Then, the joint (Joint2) and the body (Body2) are sequentially synthesized. At time "t6" when the note-off event occurs, a transition is made from the body (Body2) to the tail (Tail2) and the tail (Tail2) is then synthesized, so that a musical sound waveform of the subsequent sound 252 is synthesized as shown in FIG. 14*b*.

As described above, when the music score shown in FIG. 14*a* is played, the musical sound waveform of the previous sound 250, the mis-touching sound 251, and the subsequent sound 252 is synthesized by connecting them through the joints (Joint1) and (Joint2) as shown in FIG. 14*b*, so that the mis-touching sound 251 sounds for a longer time than the actual time length of the mis-touching. This delays the generation of the subsequent sound 252, which is a normal performance sound. In this manner, playing the pattern shown in FIG. 14*a* results in a delay in the generation of the musical sound, which causes a significant problem in listening to the musical performance sound and also makes the presence of the mis-touching sound 251 very noticeable.

FIG. 15*b* illustrates how a musical sound is synthesized when the music score shown in FIG. 15*a* is played.

When the music score shown in FIG. 15*a* is played, a note-on event of a previous sound 260 occurs at time "t1" and is then received by the synthesizer. Accordingly, the musical sound waveform synthesizer starts synthesizing a musical sound waveform of the previous sound 260 from a head (Head1) thereof at time "t1" as shown in FIG. 15*b*. Upon completing the synthesis of the head (Head1), the synthesizer still proceeds to synthesize the musical sound waveform while transitioning it from the head (Head1) to a body (Body1) since it has not received any note-off event as shown in FIG. 15*b*. When receiving a note-off event of the previous sound 260 at time "t2", the synthesizer proceeds to synthesize the musical sound waveform while transitioning it from the body (Body1) to a tail (Tail1).

Upon completing the synthesis of the tail (Tail1), the synthesizer completes the synthesis of the musical sound waveform of the previous sound 260.

Thereafter, at time "t3", the synthesizer receives a note-on event of a mis-touching sound 261 and starts synthesizing a musical sound waveform of the mis-touching sound 261 from a head (Head2) thereof as shown in FIG. 15*b*. When it receives a note-on event of a subsequent sound 262 at time "t4" before completing the synthesis of the head (Head2), the synthesizer determines that the subsequent sound 262 overlaps the mis-touching sound 261 since it still has not received any note-off event of the mis-touching sound 261 and proceeds to synthesize the musical sound waveform while transitioning it from the head (Head2) to a joint (Joint2) that represents a pitch transition part from the mis-touching sound 261 to the subsequent sound 262. Upon completing the synthesis of the joint (Joint2), the synthesizer proceeds to synthesize the musical sound waveform while transitioning it from the joint (Joint2) to a body (Body2) since it has not received any note-off event of the subsequent sound 262 as shown in FIG. 15*b*. Then, at time "t6", the synthesizer receives a note-off event of the subsequent sound 262 and proceeds to synthesize the musical sound waveform while transitioning it from the body (Body2) to a tail (Tail2). The synthesizer then completes the synthesis of the tail (Tail2), thereby completing the synthesis of the musical sound waveforms of the previous sound 260, the mis-touching sound 261, and the subsequent sound 262.

In the above manner, the head (Head1) and the body (Body1) of the previous sound 260 are sequentially synthesized, starting from the time "t1" at which the note-on event of the previous sound 260 occurs, and, at time "t2" at which a note-off event of the previous sound 260 occurs, a transition is made from the body (Body1) to the tail (Tail1) and the tail (Tail1) is then synthesized, so that a musical sound waveform of the previous sound 260 is synthesized as shown in FIG. 15*b*. The head (Head2) of the mis-touching sound 261 is synthesized, starting from the time "t3" at which the note-on event of the mis-touching sound 261 occurs, and then a transition is made to the joint (Joint2), so that a musical sound waveform of the mis-touching sound 261 is synthesized as shown in FIG. 15*b*. This joint (Joint2) represents a pitch transition part from the mis-touching sound 261 to the subsequent sound 262. The synthesis progresses while transitioning the musical sound waveform from the joint (Joint2) to the body (Body2). At time "t6" when the note-off event of the subsequent sound 262 occurs, a transition is made from the body (Body2) to the tail (Tail2) and the tail (Tail2) is then synthesized, so that a musical sound waveform of the subsequent sound 262 is synthesized as shown in FIG. 15*b*.

When the music score shown in FIG. 15*a* is played, the musical sound waveform of the head (Head1), the body (Body1), and the tail (Tail1) associated with the previous sound 260 and the musical sound waveform of the head (Head2), the joint (Joint2), the body (Body2), and the tail (Tail2) associated with the mis-touching sound 261 and the subsequent sound 262 are synthesized through different channels as shown in FIG. 15*b*. In this case, the mis-touching sound 261 and the subsequent sound 262 are connected through the joint (Joint2), so that the mis-touching sound 261 sounds for a longer time than the actual duration of the mis-operation and the generation of the subsequent sound 252, which is a normal performance sound, is delayed. In this manner, playing the pattern shown in FIG. 15*a* results in a delay in the generation of the musical sound, which causes a significant problem in listening to the musical sound performance and also makes the presence of the mis-touching sound 261 very noticeable.

In accordance with a preferred embodiment of the present invention, the above drawback is solved by the provision of a musical sound waveform synthesizer wherein, when it is detected that a second or musical sound to be subsequently generated overlaps a first or previous sound, the synthesis of a musical sound waveform of the previous sound is instantly terminated and the synthesis of a musical sound waveform of the subsequent musical sound to be generated is initiated if it is determined that the length of the previous sound does not exceed a predetermined sound length.

FIG. 1 is a block diagram of an example hardware configuration of a musical sound waveform synthesizer according to an embodiment of the present invention. The hardware configuration shown in FIG. 1 is almost the same as that of a personal computer and realizes a musical sound waveform synthesizer by running a musical sound waveform program.

In a musical sound waveform synthesizer 1 shown in FIG. 1, a Central Processing Unit (CPU) 10 controls the overall operation of the musical sound waveform synthesizer 1 and runs operating software such as a musical sound synthesis program. The operation software such as the musical sound synthesis program run by the CPU 10 or waveform data parts used to synthesize musical sounds are stored in a Read Only Memory (ROM) 11, which is a kind of machine readable medium for storing programs. A work area of the CPU 10 or a storage area of various data is set in a Random Access Memory (RAM) 12. A rewritable ROM such as a flash memory can be used as the ROM 11 so that the operating software is rewritable and the version of the operating software can be easily upgraded. This also makes it possible to update the waveform data parts stored in the ROM 11.

An operator 13 includes a performance operator such as a keyboard or a controller and a panel operator provided on a panel for performing a variety of operations. A detection circuit 14 detects an event of the operator 13 by scanning the operator 13 including the performance operator and the panel operator, and provides an event output corresponding to a portion of the operator 13 where the event has occurred. A display circuit 16 includes a display unit 15 such as an LCD. A variety of sampled waveform data or data of a variety of preset screens input through the panel operator is displayed on the display unit 15. The variety of preset screens allows a user to issue a variety of instructions using a Graphical User Interface (GUI). A waveform loader 17 includes therein an A/D converter, which can sample an analog musical sound signal, which is an external waveform signal input through a microphone, to convert it into digital data and can load it as a waveform data part into the RAM 12 or the HDD 20. The CPU 10 performs musical sound waveform synthesis to synthesize musical sound waveform data using the waveform data parts stored in the RAM 12 or the HDD 20. The synthesized musical waveform data is provided to a waveform output unit 18 via a communication bus 23 and is then stored in a buffer therein.

The waveform output unit 18 outputs musical sound waveform data stored in the buffer according to a specific output sampling frequency and provides it to a sound system 19 after performing D/A conversion. The sound system 19 generates a musical sound based on the musical sound waveform data output from the waveform output unit 18. The sound system 19 is designed to allow audio volume or quality control. An articulation table, which is used to specify waveform data parts corresponding to articulations, or articulation determination parameters used to determine articulations are stored in the ROM 11 or the hard disc 20 and a plurality of types of waveform data parts corresponding to articulations is also stored therein. The types of the waveform data parts include start waveform parts (heads), sustain waveform parts (bodies), end waveform parts (tails), and connection waveform parts (joints) of musical sound waveforms, each of the connection waveform parts representing a transition part between the pitches of two musical sounds. A communication interface (I/F) 21 connects the synthesizer 1 to a Local Area Network (LAN) or the Internet or to a communication network such as a telephone line. The musical sound waveform synthesizer 1 can be connected to an external device 22 via the communication network. The elements of the synthesizer 1 are connected to the communication bus 23. Thus, the synthesizer 1 can download a variety of programs, waveform data parts, or the like from the external device 22. The downloaded programs, waveform data parts, or the like are stored in the RAM 12 or the HDD 20.

A description will now be given of the overview of musical sound waveform synthesis of the musical sound waveform synthesizer 1 according to a preferred embodiment of the present invention that is configured as described above.

A musical sound waveform can be divided into a start waveform representing a rising edge, a sustain waveform representing a sustain part, and an end waveform representing a falling edge. A musical sound waveform produced by playing a performance such as legato, which smoothly joins together two musical sounds, includes a connection waveform where a transition is made between the pitches of the two musical sounds. In the music sound waveform synthesizer 1 according to the present invention, a plurality of types of waveform data parts including start waveform parts (hereinafter referred to as heads), sustain waveform parts (hereinafter referred to as bodies), end waveform parts (hereinafter referred to as tails), and connection waveform parts (hereinafter referred to as joints), each of which represents a transition part between the pitches of two musical sounds, are stored in the ROM 11 or the HDD 20, and musical sound waveforms are synthesized by sequentially connecting the waveform data parts. Waveform data parts or a combination thereof used when synthesizing a musical sound waveform are determined in real time according to a specified or determined articulation.

Figure 2A:
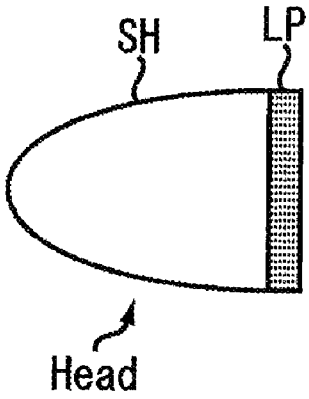
FIG. 2a (PRIOR ART)
FIGS. 2*a* through 2*d* illustrate typical examples of waveform data parts used in the musical sound waveform synthesizer according to the present invention.
Figure 2B:
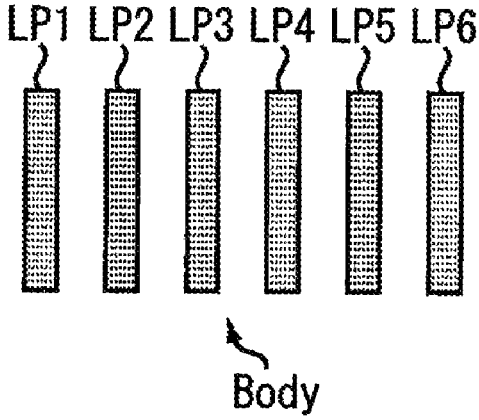
FIG. 2b (PRIOR ART)
Figure 2C:
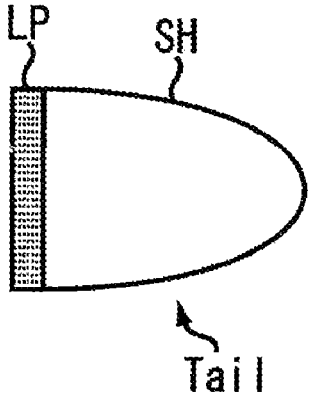
FIG. 2c (PRIOR ART)
Figure 2D:
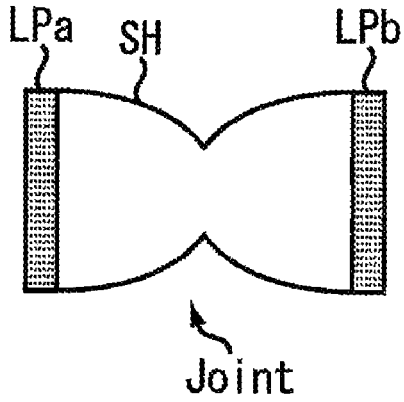
FIG. 2d (PRIOR ART)

Typical examples of the waveform data parts stored in the ROM 11 or the HDD 20 are shown in FIGS. 2*a* to 2*d*. A waveform data part shown in FIG. 2*a* is waveform data of a head and includes a one-shot waveform SH representing a rising edge of a musical sound waveform (i.e., an attack) and a loop waveform LP for connection to the next partial waveform. A waveform data part shown in FIG. 2*b* is waveform data of a body and includes a plurality of loop waveforms LP1 to LP6 representing a sustain part of a musical sound waveform. The loop waveforms LP1 to LP6 are sequentially connected through cross-fading to be synthesized, and the number of the loop waveforms corresponds to the length of the body. An arbitrary combination of the loop waveforms LP1 to LP6 may be employed. A waveform data part shown in FIG. 2*c* is waveform data of a tail and includes a one-shot waveform SH representing a falling edge of a musical sound waveform (i.e., a release thereof) and a loop waveform LP for connection to the previous partial waveform. A waveform data part shown in FIG. 2*d* is waveform data of a joint and includes a one-shot waveform SH representing a transition part between the pitches of two musical sounds, a loop waveform LPa for connection to the previous partial waveform, and a loop waveform LPb for connection to the next partial waveform. Since each of the waveform data parts has a loop waveform at its head and/or tail end, the waveform data parts can be connected through cross-fading of their loop waveforms.

When a performance is played by operating the performance operator (a keyboard, a controller, or the like) in the operator 13 in the musical sound waveform synthesizer 1, performance events are provided to the synthesizer 1 sequentially along with the play of the performance. An articulation of each played sound may be specified using an articulation setting switch and if no articulation has been specified, the articulation of each played sound may be determined from the provided performance event information. As the articulation is determined, waveform data parts used to synthesize a musical sound waveform are determined accordingly. The waveform data parts which include heads, bodies, joints, or tails corresponding to the determined articulation are specified with reference to the articulation table, and times on the time axis at which the waveform data parts are to be arranged are also specified. The specified waveform data parts are read from the ROM 11 or the HDD 20 and are then sequentially synthesized at the specified times, thereby synthesizing the musical sound waveform.

Figure 12:
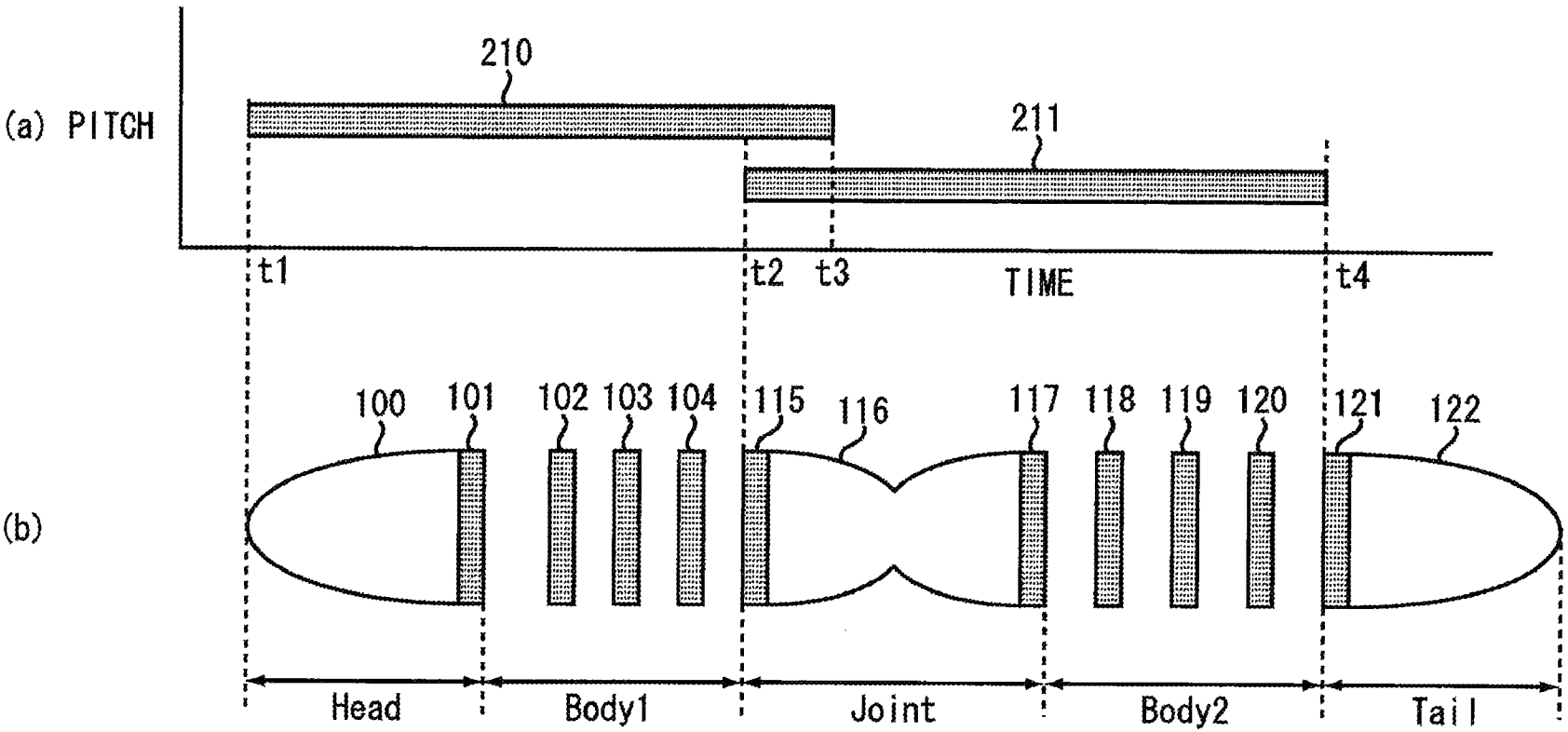
FIG. 12 (PRIOR ART)
FIGS. 12*a* and 12*b* illustrate another example of a musical sound waveform synthesized in the musical sound waveform synthesizer in contrast with a corresponding music score that is played.
Figure 13:
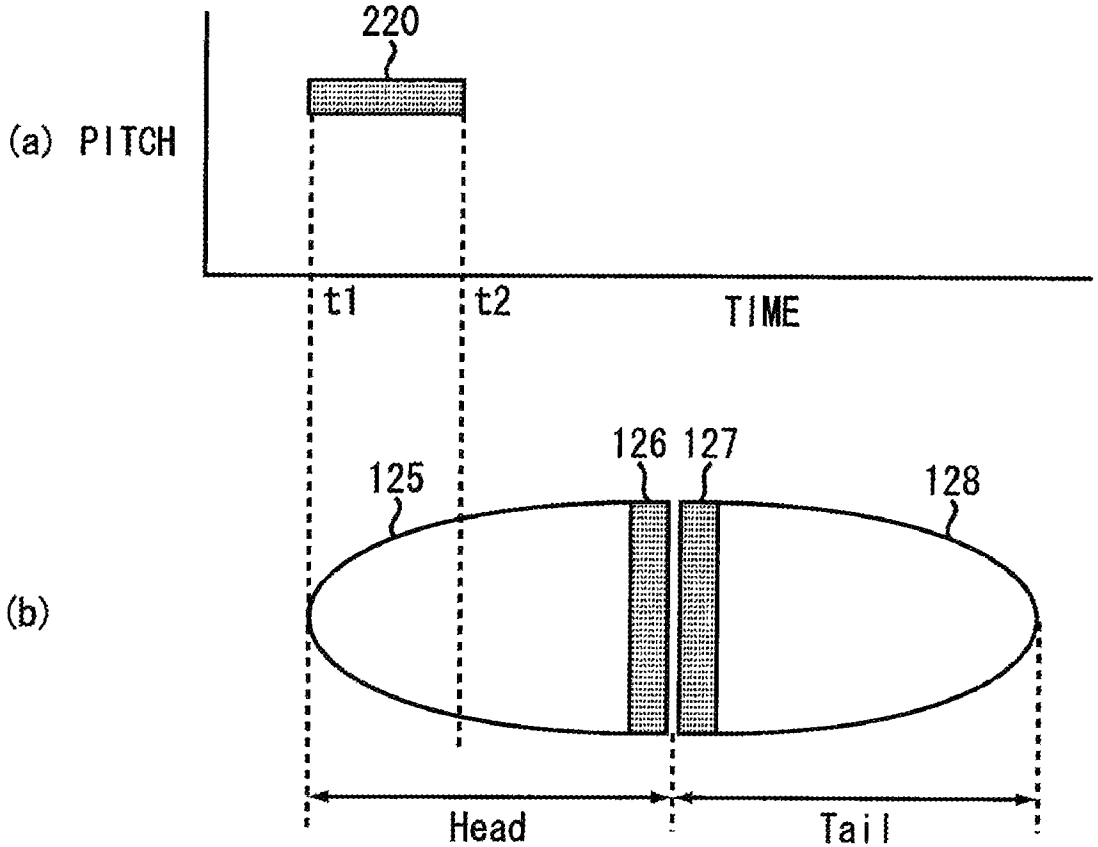
FIG. 13 (PRIOR ART)
FIGS. 13*a* and 13*b* illustrate another example of a musical sound waveform synthesized in the musical sound waveform synthesizer in contrast with a corresponding music score that is played.

When a legato performance is played to connect two sounds as with the music score shown in FIG. 12*a*, it is determined that the legato performance has been played since the note-on event of the musical sound 211 is received before the note-off event of the musical sound 210 is received. The length of the musical sound 210 is obtained by subtracting the time "t1" from the time "t2". The length of the musical sound is contrasted with a specific length determined according to a performance parameter. In this example, it is determined that the length of the musical sound 210 exceeds the specific length. Accordingly, it is determined that the legato performance has been played, and the musical sound 210 and the musical sound 211 are synthesized using a joint (Joint). As shown in FIG. 12*b*, the head (Head), the body (Body1), the joint (Joint), the body (Body2), and the tail (Tail) are sequentially arranged on the time axis, starting from the time "t1" when the note-on event occurs, thereby synthesizing the musical sound waveform. Waveform data parts used as the head (Head), the body (Body1), the joint (Joint), the body (Body2), and the tail (Tail) are specified with reference to the articulation table, and times on the time axis at which the waveform data parts are arranged are also specified. The specified waveform data parts are read from the ROM 11 and the HDD 20 and are then sequentially synthesized at the specified times, thereby synthesizing the musical sound waveform.

Figure 14:
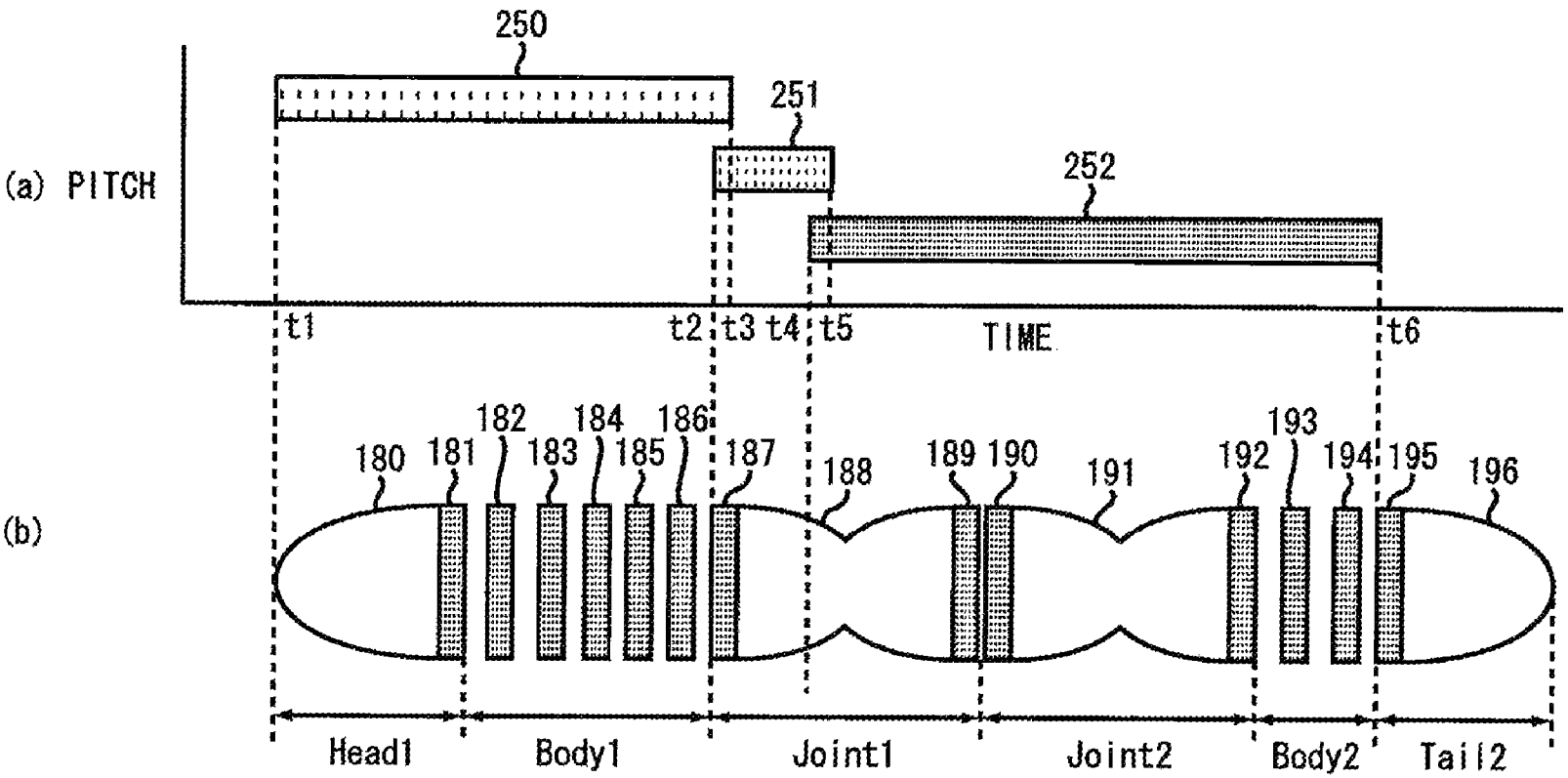
FIG. 14 (PRIOR ART)
FIGS. 14*a* and 14*b* illustrate a music score to be played and a musical sound waveform synthesized by a musical sound waveform synthesizer when the music score is played.
Figure 15:
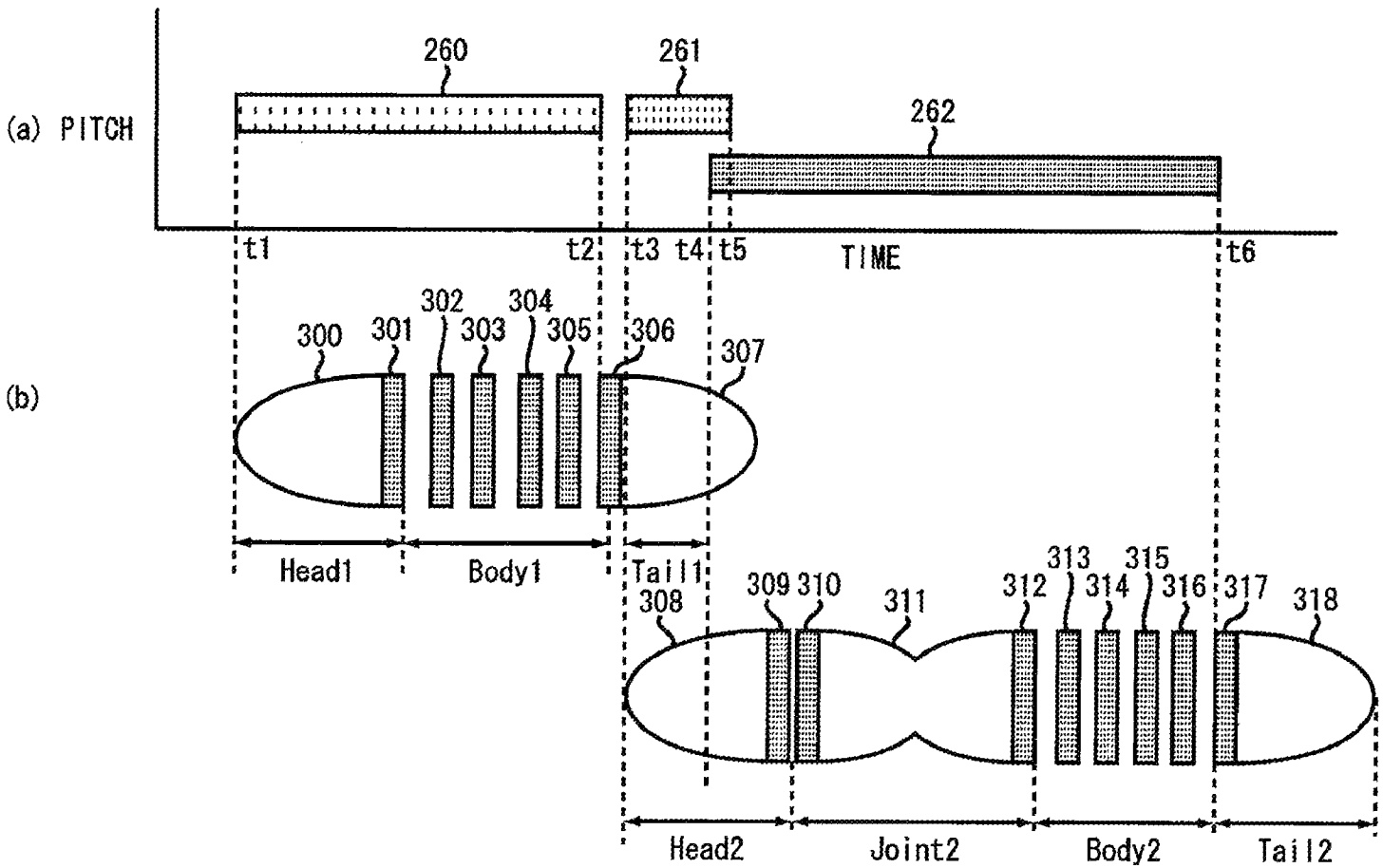
FIG. 15 (PRIOR ART)
FIGS. 15*a* and 15*b* illustrate another music score to be played and a musical sound waveform synthesized by the musical sound waveform synthesizer when the music score is played.

FIGS. 14 and 15 illustrate example patterns of a short sound generated through mis-touching or the like as described above. When the conventional musical sound waveform synthesizer synthesizes a musical sound waveform from a pattern of a short sound, the generation of a subsequent sound subsequent to the short sound is delayed. Therefore, as described later, the musical sound waveform synthesizer 1 according to the present invention determines whether a short sound has been inputted through mis-touching, fast playing, or the like, based on the length of the input sound. When a short sound has been inputted inputted through mis-touching, fast playing, or the like, the synthesizer starts synthesizing a musical sound waveform of a subsequent sound, at the moment when a note-on event of the subsequent sound is inputted, even if the short sound overlaps the subsequent sound. Accordingly, the musical sound waveform synthesizer 1 according to the present invention synthesizes a musical sound waveform without delaying the generation of the subsequent sound even if such a short sound pattern is played, which will be described in detail later.

Figure 3:
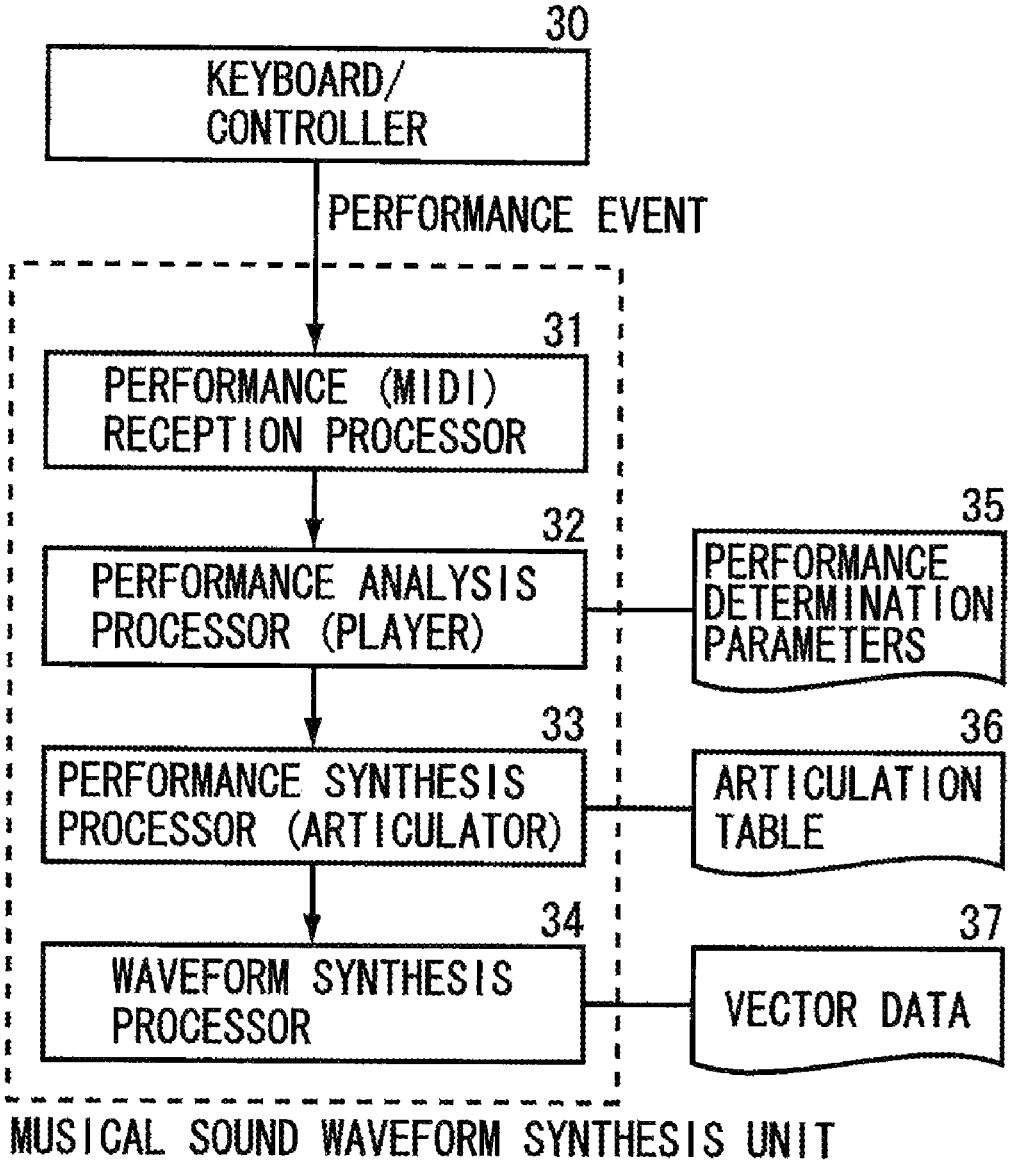
FIG. 3 is a block diagram illustrating a function of performing musical sound waveform synthesis in the musical sound waveform synthesizer according to the present invention.

FIG. 3 is a block diagram illustrating a function of performing musical sound waveform synthesis in the musical sound waveform synthesizer 1 according to the present invention.

In the functional block diagram of FIG. 3, a keyboard/controller 30 is a performance operator in the operator 13, and performance events detected as the keyboard/controller 30 is operated are provided to a musical sound waveform synthesis unit. The musical sound waveform synthesis unit is realized by running a musical sound waveform program by the CPU 1 and includes a performance (MIDI) reception processor 31, a performance analysis processor (player) 32, a performance synthesis processor (articulator) 33, and a waveform synthesis processor 34. A storage area of a vector data storage 37 in which articulation determination parameters 35, an articulation table 36, and waveform data parts are stored as vector data is set in the ROM 11 or the HDD 20.

In FIG. 3, a performance event detected as the keyboard/controller 30 is operated is formed in a MIDI format, which includes articulation specifying data and note data input in real time, and it is then input to the musical sound waveform synthesis unit. In this case, the performance event may not include the articulation specifying data. Not only the note data but also a variety of sound source control data such as volume control data may be added to the performance event. The performance (MIDI) reception processor 31 in the musical sound waveform synthesis unit receives the performance event input from the keyboard/controller 30 and the performance analysis processor (player) 32 interprets the performance event. Based on the input performance event, the performance analysis processor (player) 32 determines its articulation using the articulation determination parameters 35. The articulation determination parameters 35 include an articulation determination time parameter used to detect a short sound generated through fast playing or mis-touching. The length of the sound is obtained from the input performance event and the obtained sound length is contrasted with the articulation determination time to determine whether the corresponding articulation is a joint-based articulation using a joint or a non-joint-based articulation using no joint. As the articulation is determined, waveform data parts to be used are determined according to the determined articulation.

In the performance synthesis processor (articulator) 33, waveform data parts corresponding to the articulation determined by the analysis of the performance analysis processor (player) 32 are specified with reference to the articulation table 36 and times on the time axis at which the waveform data parts are arranged are also specified. The waveform synthesis processor 34 reads vector data of the specified waveform data parts from the vector data storage 37, which includes the ROM 11 or the HDD 20, and then sequentially synthesizes the specified waveform data parts at the specified times, thereby synthesizing the musical sound waveform.

The articulation synthesis processor (articulator) 33 determines waveform data parts to be used based on the articulation determined based on the received event information or an articulation corresponding to articulation specifying data that has been set using the articulation setting switch.

Figure 4:
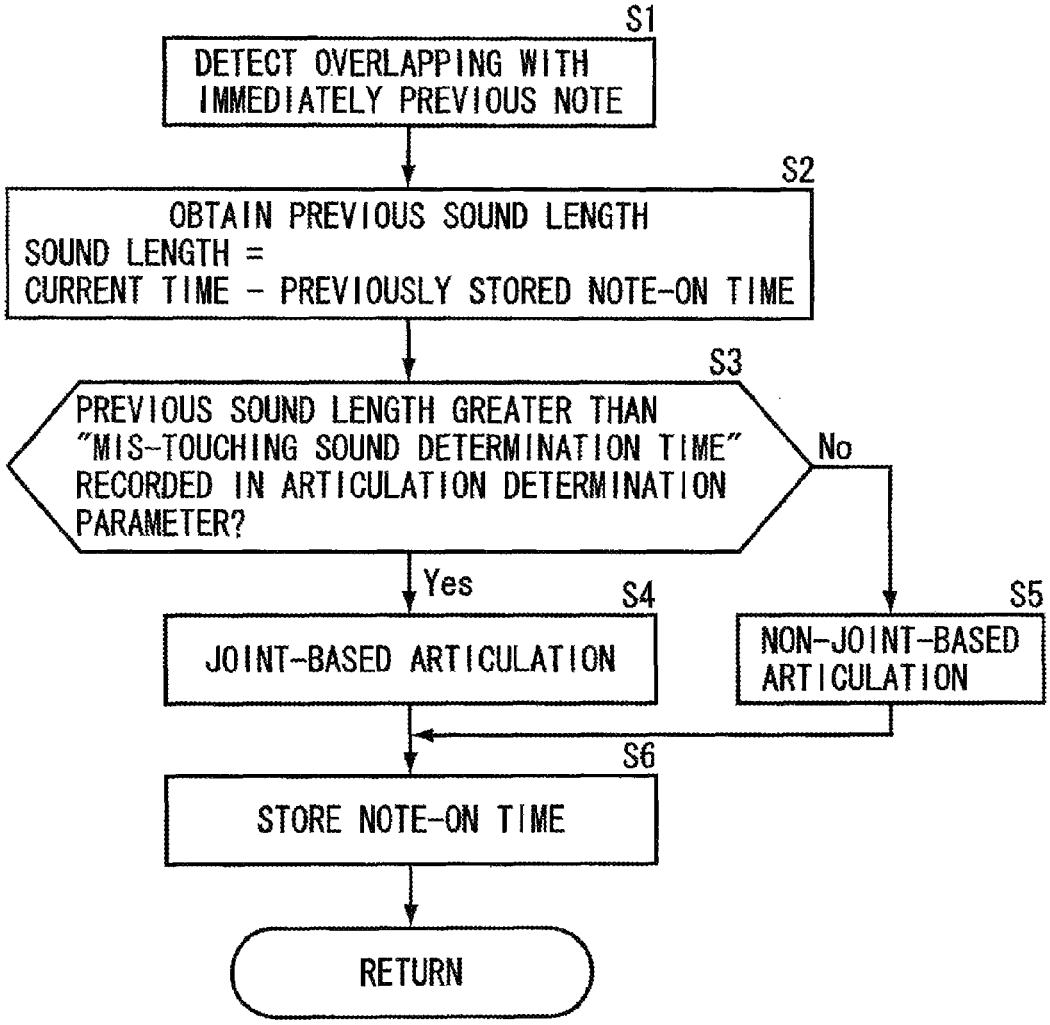
FIG. 4 is a flow chart of an articulation determination process performed in the musical sound waveform synthesizer according to the present invention.

FIG. 4 is a flow chart of a characteristic articulation determination process performed by the articulation analysis processor (player) 32 in the musical sound waveform synthesizer 1 according to the present invention.

The articulation determination process shown in FIG. 4 is activated when a subsequent note-on event is received during a musical sound waveform synthesis process performed in response to receipt of a note-on event of a previous sound so that it is detected that the subsequent note-on event overlaps the generation of the previous sound (S1). It may be detected that the subsequent note-on event overlaps the generation of the previous sound when the performance (MIDI) reception processor 31 receives the subsequent note-on event before receiving a note-off event of the previous sound. When it is detected that the note-on event overlaps the duration of the previous sound, the length of the previous sound is obtained, at step S2, by subtracting a previously stored time (i.e., a previous sound note-on time) when the note-on event of the previous sound was received from the current time. Then, it is determined at step S3 whether or not the obtained length of the previous sound is greater than a "mis-touching sound determination time" that has been stored as an articulation determination time parameter. When it is determined that the obtained length of the previous sound is greater than the mis-touching sound determination time, the process proceeds to step S4 to determine that the articulation is a joint-based articulation which allows a musical sound waveform to be synthesized using a joint. When it is determined that the obtained length of the previous sound is less than or equal to the mis-touching sound determination time, the process proceeds to step S5 to terminate the previous sound and also to determine that the articulation is a non-joint-based articulation which allows a musical sound waveform of the corresponding sound to be newly synthesized, starting from its head, through a different synthesis channel without using a joint. When the articulation has been determined at step S4 or S5, the time when the subsequent note-on event has been inputted is stored and the articulation determination process is terminated, and then the synthesizer returns to the musical sound waveform synthesis process.

Figure 5:
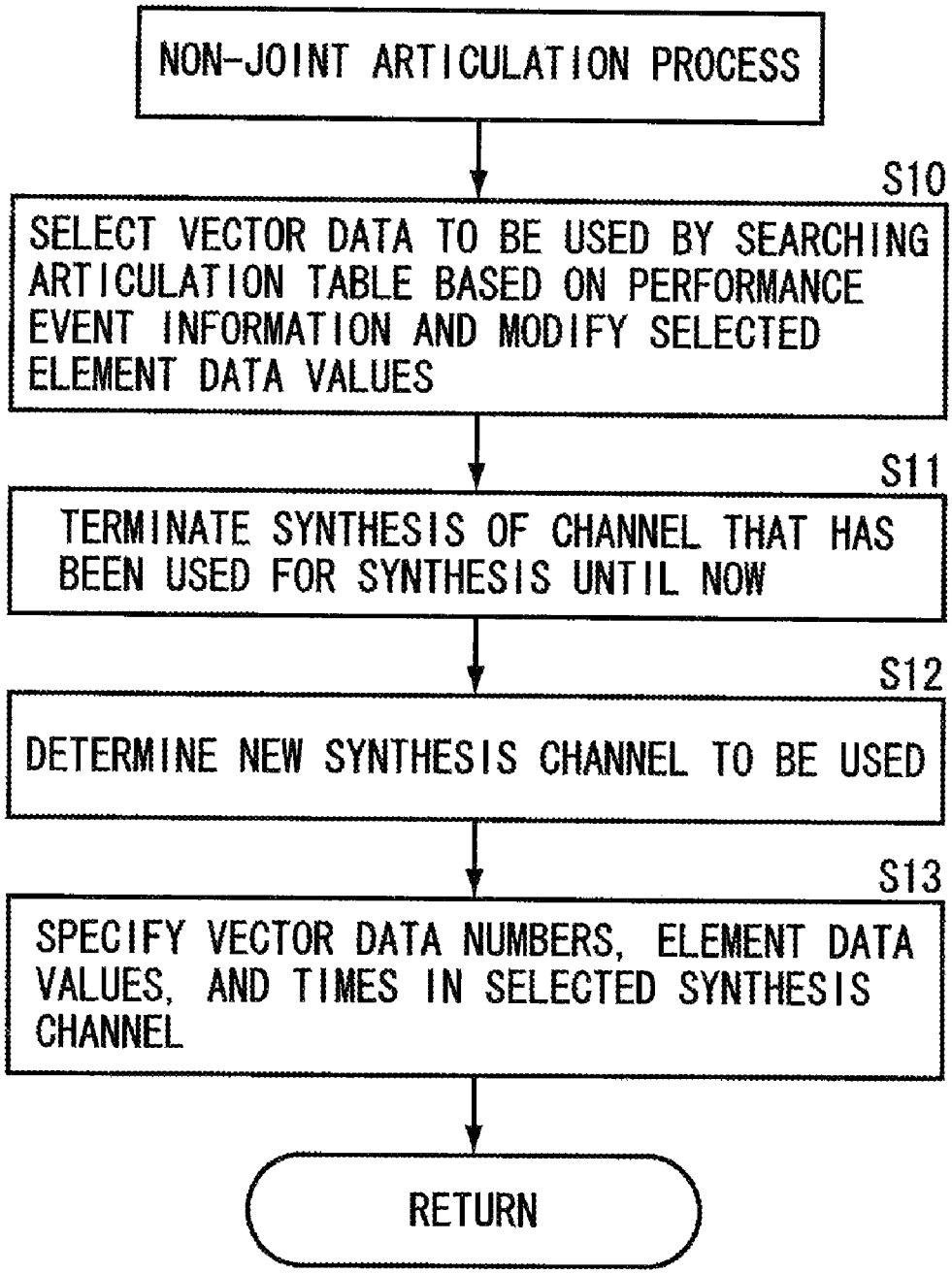
FIG. 5 is an example flow chart of a non-joint articulation process performed in a performance synthesis processor (articulator) in the musical sound waveform synthesizer according to the present invention.

FIG. 5 is an example flow chart of how the performance synthesis processor (articulator) 33 performs a non-joint articulation process when it has been determined that a musical sound waveform is to be synthesized using a non-joint articulation.

When a non-joint articulation process is activated, vector data of waveform data parts to be used is selected by searching the articulation table 36 based on performance event information and element data (or data of elements) included in the selected vector data is modified based on the performance event information at step S10. The element data includes waveform (or timbre) elements, pitch elements, and amplitude elements of harmonic components and waveform (or timbre) elements and amplitude elements of non-harmonic components. The waveform data parts are formed using the vector data including these elements. The element data can vary with time.

Then, at step S11, an instruction to terminate a musical sound waveform that is in process of being synthesized through a synthesis channel that has been used until now is issued to the waveform synthesis processor 34. In this case, if the musical sound waveform is terminated during synthesis of the waveform data part, it sounds like an unnatural musical sound. Therefore, the waveform synthesis processor 34, which has received the instruction, terminates the musical sound waveform after waiting until its waveform data part in process of being synthesized is completely synthesized. Specifically, when a one-shot musical sound waveform such as a head, a joint, or a tail is in process of being synthesized, the waveform synthesis processor 34 completely synthesizes the one-shot musical sound waveform to the end thereof. The performance synthesis processor 33 and the waveform synthesis processor 34 are operated by multitasking of the CPU 10, so that the performance synthesis processor 33 proceeds to the next step S12 while the waveform synthesis processor 34 is in process of terminating the synthesis. Then, at step S12, the performance synthesis processor 33 determines a new synthesis channel to be used to synthesize a musical sound waveform for the received note-on event. Then, at step S13, the performance synthesis processor 33 prepares for synthesis of a musical sound waveform by specifying vector data numbers, element data values, and times of waveform data parts to be used for the determined synthesis channel. Accordingly, the non-joint articulation process is terminated and then the synthesizer returns to the musical sound waveform synthesis process, so that the synthesis through the synthesis channel that has been used until now is terminated and the musical sound waveform for the received note-on event is synthesized through the determined synthesis channel.

A description will now be given of an example in which the articulation analysis processor (player) 32 performs an articulation determination process, including the articulation determination process shown in FIG. 4, to determine an articulation and thus to determine waveform data parts used to synthesize a musical sound waveform and the articulation synthesis processor (articulator) 33 and the waveform synthesis processor 34 synthesize the musical sound waveform. In this example, the articulation determination process shown in FIG. 4 is performed to determine whether the corresponding articulation is a joint-based articulation or a non-joint-based articulation.

Figure 6:
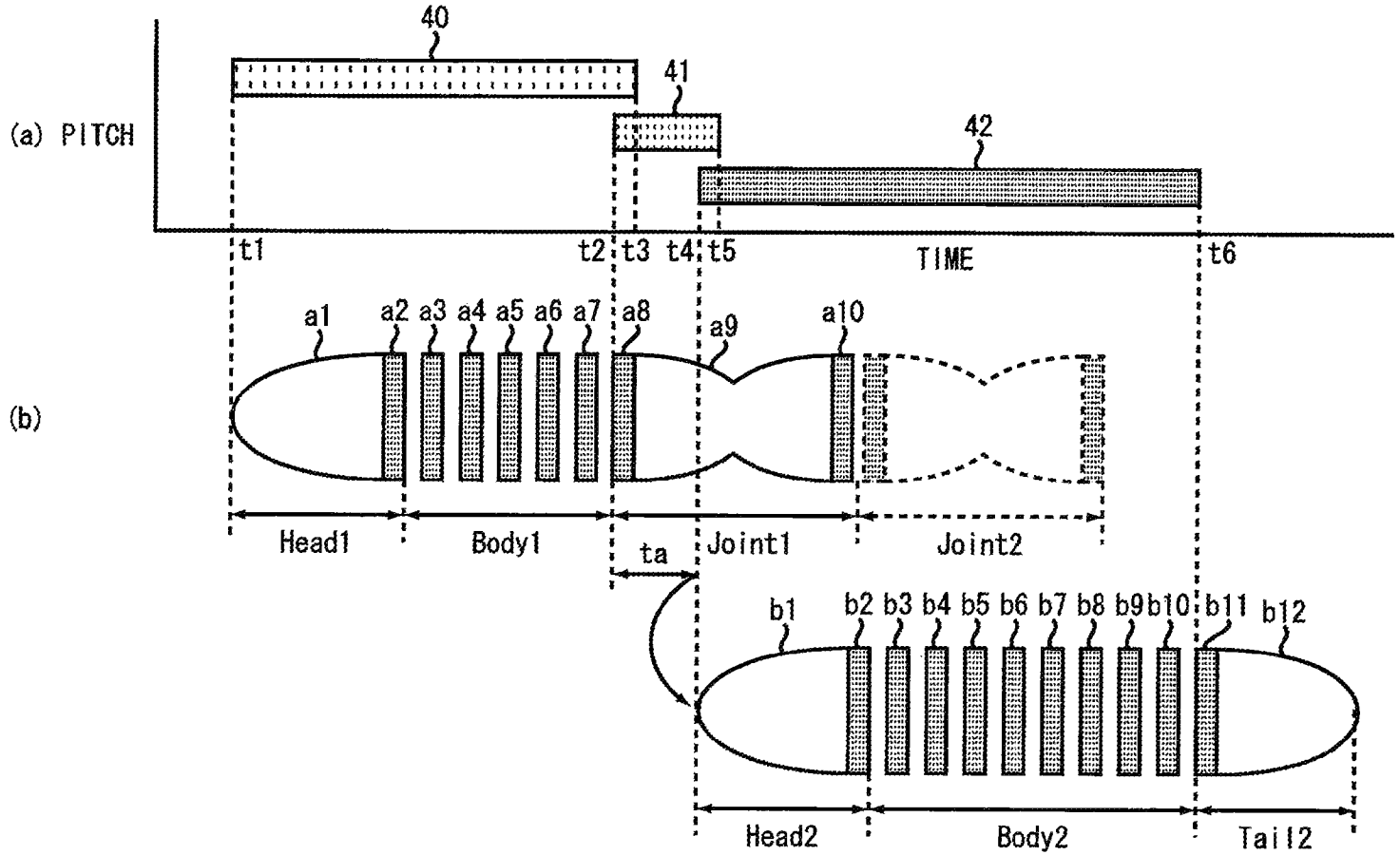
FIGS. 6*a* and 6*b* illustrate an example of a musical sound waveform synthesized in the musical sound waveform synthesizer according to the present invention in contrast with a corresponding music score that is played.

FIGS. 6*a* and 6*b* illustrate an example of the synthesis of a musical sound waveform in the musical sound waveform synthesizer 1 when the music score shown in FIG. 14*a* is played.

FIG. 6*a* shows the same music score written in piano roll notation as shown in FIG. 14*a*. When the keyboard/controller 30 in the operator 13 is operated to play the music score, the performance (MIDI) reception processor 31 receives a note-on event of a previous sound 40 at time "t1". Accordingly, the musical sound waveform synthesizer starts synthesizing a musical sound waveform of the previous sound 40 from a head (Head1) as shown in FIG. 6*b* at time "t1". Upon completing the synthesis of the head (Head1), the musical sound waveform synthesizer still proceeds to synthesize the musical sound waveform while transitioning it from the head (Head1) to a body (Body1) since it has not received any note-off event of the previous sound 40 as shown in FIG. 6*b*. When it receives a note-on event of a mis-touching sound 41 at time "t2", the musical sound waveform synthesizer determines that the mis-touching sound 41 overlaps the previous sound 40 since it still has not received any note-off event of the previous sound 40, and activates the articulation determination process shown in FIG. 4 and obtains the length of the previous sound 40. The obtained length of the previous sound 40 is contrasted with a "mis-touching sound determination time" parameter in the articulation determination parameters 35. Here, the articulation is determined to be a joint-based articulation since the length of the previous sound 40 is greater than the "mis-touching sound determination time". Accordingly, at time "t2" the synthesizer proceeds to synthesize the musical sound waveform while transitioning it from the body (Body1) to a joint (Joint1) representing a pitch transition part from the previous sound 40 to the mis-touching sound 41.

Then, at time "t3", the synthesizer receives a note-off event of the previous sound 40. When it receives a note-on event of a subsequent sound 42 at time "t4" before the synthesis of the joint (Joint1) is completed, the musical sound waveform synthesizer determines that the subsequent sound 42 overlaps the mis-touching sound 41 since it still has not received any note-off event of the mis-touching sound 41, and activates the articulation determination process shown in FIG. 4 and obtains the length "ta" of the mis-touching sound 41. The obtained length "ta" of the mis-touching sound 41 is contrasted with the "mis-touching sound determination time" parameter in the articulation determination parameters 35. The articulation is determined to be a non-joint-based articulation since the length "ta" of the mis-touching sound 41 is less than or equal to the "mis-touching sound determination time". Accordingly, upon terminating the synthesis of the joint (Joint1), the synthesizer terminates the mis-touching sound 41 without using a joint (Joint2), and starts synthesizing the musical sound waveform of the subsequent sound 42 from a head (Head2) at time "t4". Then, at time "t5", the synthesizer receives a note-off event of the mis-touching sound 41. Upon completing the synthesis of the head (Head2), the musical sound waveform synthesizer still proceeds to synthesize the musical sound waveform while transitioning it from the head (Head2) to a body (Body2) since it has not received any note-off event of the subsequent sound 42 as shown in FIG. 6*b*. Then, at time "t6", the synthesizer receives a note-off event of the subsequent sound 42 and proceeds to synthesize the musical sound waveform while transitioning it from the body (Body2) to a tail (Tail2). The synthesizer then completes the synthesis of the tail (Tail2), thereby completing the synthesis of the musical sound waveforms of the previous sound 40, the mis-touching sound 41, and the subsequent sound 42.

In this manner, the synthesizer performs the joint-based articulation process using a joint when joining together the previous sound 40 and the mis-touching sound 41 and performs the non-joint-based articulation process shown in FIG. 5 when joining together the mis-touching sound 41 and the subsequent sound 42. Accordingly, the musical sound waveform of the previous sound 40 and the mis-touching sound 41 is synthesized using the head (Head1), the body (Body1), and the joint (Joint1), and the musical sound waveform of the subsequent sound 42 is synthesized using a combination of the head (Head2), the body (Body2), and the tail (Tail2). In the performance synthesis processor (articulator) 33, vector data numbers and element data values of waveform data parts used for the waveform data parts determined based on the articulation determined by the analysis of the performance analysis processor (player) 32 are specified with reference to the articulation table 36 and times on the time axis at which the waveform data parts are arranged are also specified. Specifically, it is specified in the first synthesis channel that the head (Head1) be initiated from the time "t1", the body (Body1) be arranged to follow the head (Head1), and the joint (Joint1) be initiated from the time "t2". In addition, it is specified in the second synthesis channel that the head (Head2) be initiated from the time "t4", the body (Body2) be arranged to follow the head (Head2), and the tail (Tail2) be initiated from the time "t6". The waveform synthesis processor 34 reads vector data of waveform data parts of the specified vector data numbers from the vector data storage 37, which includes the ROM 11 or the HDD 20, and then sequentially synthesizes the waveform data parts at the specified times based on the specified element data values. In this case, the musical sound waveform of the previous sound 40 and the mis-touching sound 41 including the head (Head1), the body (Body1), and the joint (Joint1) is synthesized through the first synthesis channel and the musical sound waveform of the subsequent sound 42 including the head (Head2), the body (Body2), and the tail (Tail2) is synthesized through the second synthesis channel.

Accordingly, when a performance is played as shown in FIG. 6*a*, a musical sound waveform is synthesized as shown in FIG. 6*b*. Specifically, the waveform synthesis processor 34 reads head vector data of the specified vector data number at the time "t1" in the first synthesis channel from the vector data storage 37 and then proceeds to synthesize the head (Head1). This head vector data includes a one-shot waveform a1 representing an attack of the previous sound 40 and a loop waveform a2 connected to the tail end of the one-shot waveform a1. Upon completing the synthesis of the musical sound waveform of the head (Head1), the waveform synthesis processor 34 reads body vector data of the specified vector data number from the vector data storage 37 and proceeds to synthesize the musical sound waveform of the body (Body1). The specified body vector data of the previous sound 40 includes a plurality of loop waveforms a3, a4, a5, a6, and a7 of different tone colors and a transition is made from the head (Head1) to the body (Body1) by cross-fading the loop waveforms a2 and a3. The musical sound waveform of the body (Body1) is synthesized by connecting the loop waveforms a3, a4, a5, a6, and a7 through cross-fading, so that the synthesis of the musical sound waveform of the body (Body1) progresses while changing its tone color.

Then, at time "t2", the waveform synthesis processor 34 reads joint vector data of the specified vector data number from the vector data storage 37 and then proceeds to synthesize the joint (Joint1). The specified joint vector data represents a pitch transition part from the previous sound 40 to the mis-touching sound 41 and includes a one-shot waveform a9, a loop waveform a8 connected to the head end of the one-shot waveform a9, and a loop waveform a10 connected to the tail end thereof. A transition is made from the body (Body1) to the joint (Joint1) by cross-fading the loop waveforms a7 and a8. As the synthesis of the joint (Joint1) progresses, a transition is made from the musical sound waveform of the previous sound 40 to that of the mis-touching sound 41. When the synthesis of the musical sound waveform of the joint (Joint1) is completed, the synthesis of the musical sound waveform of the first synthesis channel is completed.

Then, at time "t4", the waveform synthesis processor 34 reads head vector data of the specified vector data number from the vector data storage 37 and then proceeds to synthesize the head (Head2) through the second synthesis channel. The specified head vector data includes a one-shot waveform b1 representing an attack of the subsequent sound 42 and a loop waveform b2 connected to the tail end of the one-shot waveform b1. Upon completing the synthesis of the musical sound waveform of the head (Head2), the waveform synthesis processor 34 reads body vector data of the specified vector data number from the vector data storage 37 and proceeds to synthesize the musical sound waveform of the body (Body2). The specified body vector data of the subsequent sound 42 includes a plurality of loop waveforms b3, b4, b5, b6, b7, b8, b9, and b10 of different tone colors and a transition is made from the head (Head2) to the body (Body2) by cross-fading the loop waveforms b2 and b3. The musical sound waveform of the body (Body2) is synthesized by connecting the loop waveforms b3, b4, b5, b6, b7, b8, b9, and b10 through cross-fading, so that the synthesis of the musical sound waveform of the body (Body2) progresses while changing its tone color.

Then, at time "t6", the waveform synthesis processor 34 reads tail vector data of the specified vector data number from the vector data storage 37 and then proceeds to synthesize the tail (Tail2). The tail vector data of the specified vector data number represents a release of the subsequent sound 42 and includes a one-shot waveform b12 and a loop waveform b11 connected to the head end of the one-shot waveform b12. A transition is made from the body (Body2) to the tail (Tail2) by cross-fading the loop waveforms b10 and b11. When the synthesis of the musical sound waveform of the tail (Tail2) is completed, the synthesis of the musical sound waveforms of the previous sound 40, the mis-touching sound 41, and the subsequent sound 42 is completed.

As shown in FIG. 6*b*, in the case where the mis-touching sound 41 having a short sound length overlaps both the previous sound 40 and the subsequent sound 42, the joint articulation process is performed when the musical sound waveform synthesis is performed from the previous sound 40 to the mis-touching sound 41 and the non-joint articulation process shown in FIG. 5 is performed when the musical sound waveform synthesis is performed from the mis-touching sound 41 to the subsequent sound 42. Accordingly, the musical sound waveform of the mis-touching sound 41 is terminated at the joint (Joint1), and the musical sound waveform of a joint (Joint2) denoted by dotted lines is not synthesized. Therefore, the musical sound waveform of the mis-touching sound 41 is shortened and the mis-touching sound 41 is not self-sustained. In addition, the musical sound waveform of the subsequent sound 42 is synthesized through a new synthesis channel, starting from the time "t4" when the note-on event of the subsequent sound 42 occurs, thereby preventing delay in the generation of the subsequent sound 42 due to the presence of the mis-touching sound 41.

Figure 7:
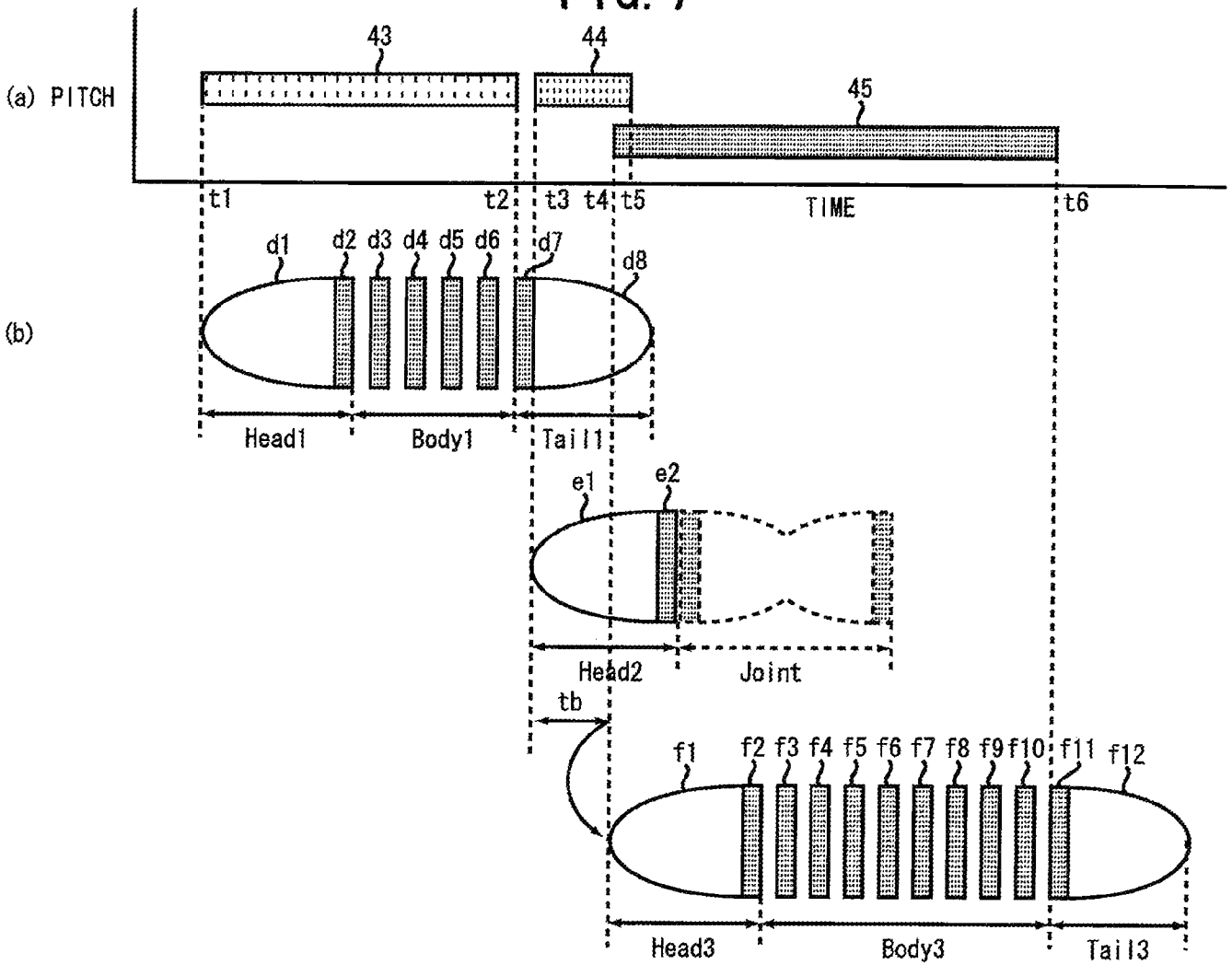
FIGS. 7*a* and 7*b* illustrate another example of a musical sound waveform synthesized in the musical sound waveform synthesizer according to the present invention in contrast with a corresponding music score that is played.

FIGS. 7*a* and 7*b* illustrate an example of the synthesis of a musical sound waveform in the musical sound waveform synthesizer 1 when the music score shown in FIG. 15*a* is played.

FIG. 7*a* shows the same music score written in piano roll notation as shown in FIG. 15*a*. When the keyboard/controller 30 in the operator 13 is operated to play the music score, the performance (MIDI) reception processor 31 receives a note-on event of a previous sound 43 at time "t1". Accordingly, the musical sound waveform synthesizer starts synthesizing a musical sound waveform of the previous sound 43 from a head (Head1) as shown in FIG. 7*b* at time "t1". Upon completing the synthesis of the head (Head1), the musical sound waveform synthesizer still proceeds to synthesize the musical sound waveform while transitioning it from the head (Head1) to a body (Body1) since it has not received any note-off event of the previous sound 43 as shown in FIG. 7*b*. At time "t2", the performance (MIDI) reception processor 31 receives a note-off event of the previous sound 43 and the synthesizer proceeds to synthesize the musical sound waveform while transitioning it from the body (Body1) to a tail (Tail1). By completing the synthesis of the tail (Tail1), the synthesizer completes the synthesis of the musical sound waveform of the previous sound 43. At time "t3" immediately after time "t2", the performance (MIDI) reception processor 31 receives a note-on event of a mis-touching sound 44 and the synthesizer starts synthesizing a musical sound waveform of the mis-touching sound 44 from a head (Head2) thereof as shown in FIG. 7*b*.

When it receives a note-on event of a subsequent sound 45 at time "t4" before the synthesis of the head (Head2) is completed, the musical sound waveform synthesizer determines that the subsequent sound 45 overlaps the mis-touching sound 44 since it still has not received any note-off event of the mis-touching sound 44, and activates the articulation determination process shown in FIG. 4 and obtains the length "tb" of the mis-touching sound 44. The obtained length "tb" of the mis-touching sound 44 is contrasted with the "mis-touching sound determination time" parameter in the articulation determination parameters 35. The articulation is determined to be a non-joint-based articulation since the length "tb" of the mis-touching sound 44 is less than or equal to the "mis-touching sound determination time". Accordingly, upon terminating the synthesis of the head (Head2), the synthesizer terminates the mis-touching sound 44 without using a joint, and starts synthesizing the musical sound waveform of the subsequent sound 45 from a head (Head3) at time "t4". Then, at time "t5", the synthesizer receives a note-off event of the mis-touching sound 44. Upon completing the synthesis of the head (Head3), the musical sound waveform synthesizer still proceeds to synthesize the musical sound waveform while transitioning it from the head (Head3) to a body (Body3) since it has not received any note-off event of the subsequent sound 45 as shown in FIG. 7*b*. Then, at time "t6", the synthesizer receives a note-off event of the subsequent sound 45 and proceeds to synthesize the musical sound waveform while transitioning it from the body (Body3) to a tail (Tail3). The synthesizer then completes the synthesis of the tail (Tail3), thereby completing the synthesis of the musical sound waveforms of the previous sound 43, the mis-touching sound 44, and the subsequent sound 45.

In this manner, the musical sound waveform of the previous sound 43 is synthesized through a first synthesis channel, starting from the time "t1" when it receives the note-on event of the previous sound 43. Specifically, the musical sound waveform of the previous sound 43 is synthesized by combining the head (Head1), the body (Body1), and the tail (Tail1). The musical sound waveform of the mis-touching sound 44 is synthesized through a second synthesis channel, starting from the time "t3" when the note-on event of the mis-touching sound 44 occurs. The synthesizer performs the non-joint-based articulation process shown in FIG. 5 when joining together the mis-touching sound 44 and the subsequent sound 45. The musical sound waveform of the mis-touching sound 44 is synthesized using only the head (Head2) as the non-joint articulation process is performed and the musical sound waveform of the subsequent sound 45 is synthesized using a combination of the head (Head3), the body (Body3), and the tail (Tail3) through a third synthesis channel. Thus, the musical sound waveform of the mis-touching sound 44 is terminated at the head (Head2).

In the performance synthesis processor (articulator) 33, vector data numbers and element data values of waveform data parts used for the waveform data parts determined based on the articulation determined by the analysis of the performance analysis processor (player) 32 are specified with reference to the articulation table 36 and times on the time axis at which the waveform data parts are arranged are also specified. Specifically, it is specified in the first synthesis channel that the head (Head1) be initiated from the time "t1", the body (Body1) be arranged to follow the head (Head1), and the tail (Tail1) be initiated from the time "t2". In addition, it is specified in the second synthesis channel that the head (Head2) be initiated from the time "t3" and it is specified in the third synthesis channel that the head (Head3) be initiated from the time "t4", the body (Body3) be arranged to follow the head (Head3), and the tail (Tail3) be initiated from the time "t6". The waveform synthesis processor 34 reads vector data of waveform data parts of the specified vector data numbers from the vector data storage 37, which includes the ROM 11 or the HDD 20, and then sequentially synthesizes the waveform data parts at the specified times based on the specified element data values. In this case, the musical sound waveform of the previous sound 43 including the head (Head1), the body (Body1), and the tail (Tail1) is synthesized through the first synthesis channel, the musical sound waveform of the mis-touching sound 44 including the head (Head2) is synthesized through the second synthesis channel, and the musical sound waveform of the subsequent sound 45 including the head (Head3), the body (Body3), and the tail (Tail3) is synthesized through the third synthesis channel.

Accordingly, when a performance is played as shown in FIG. 7*a*, a musical sound waveform is synthesized as shown in FIG. 7*b*. Specifically, the waveform synthesis processor 34 reads head vector data of the specified vector data number at the time "t1" in the first synthesis channel from the vector data storage 37 and then proceeds to synthesize the head (Head1). This head vector data includes a one-shot waveform "d1" representing an attack of the previous sound 43 and a loop waveform "d2" connected to the tail end of the one-shot waveform "d1." Upon completing the synthesis of the musical sound waveform of the head (Head1), the waveform synthesis processor 34 reads body vector data of the specified vector data number from the vector data storage 37 and proceeds to synthesize the musical sound waveform of the body (Body1). The specified body vector data of the previous sound 43 includes a plurality of loop waveforms "d3," "d4," "d5," and "d6" of different tone colors and a transition is made from the head (Head1) to the body (Body1) by cross-fading the loop waveforms "d2" and "d3." The musical sound waveform of the body (Body1) is synthesized by connecting the loop waveforms "d3," "d4," "d5," and "d6" through cross-fading, so that the synthesis of the musical sound waveform of the body (Body1) progresses while changing its tone color.

Then, at time "t2", the waveform synthesis processor 34 reads tail vector data of the specified vector data number from the vector data storage 37 and then proceeds to synthesize the tail (Tail1). The tail vector data of the specified vector data number represents a release of the previous sound 43 and includes a one-shot waveform d8 and a loop waveform d7 connected to the head end of the one-shot waveform d8. A transition is made from the body (Body1) to the tail (Tail1) by cross-fading the loop waveforms d6 and d7. By completing the synthesis of the musical sound waveform of the tail (Tail1), the synthesizer completes the synthesis of the musical sound waveform of the previous sound 43 in the first synthesis channel.

At time "t3", the waveform synthesis processor 34 reads head vector data of the specified vector data number in the second synthesis channel from the vector data storage 37 and then proceeds to synthesize the head (Head2). This head vector data includes a one-shot waveform e1 representing an attack of the mis-touching sound 44 and a loop waveform e2 connected to the tail end of the one-shot waveform e1. When the musical sound waveform of this head (Head2) is completed, the synthesis of the musical sound waveform of the mis-touching sound 44 in the second synthesis channel is completed, without synthesizing a joint thereof.

Then, at time "t4", the waveform synthesis processor 34 reads head vector data of the specified vector data number from the vector data storage 37 and then proceeds to synthesize the head (Head3) through the third synthesis channel. The specified head vector data includes a one-shot waveform "f1" representing an attack of the subsequent sound 45 and a loop waveform "f2" connected to the tail end of the one-shot waveform "f1". Upon completing the synthesis of the musical sound waveform of the head (Head3), the waveform synthesis processor 34 reads body vector data of the specified vector data number from the vector data storage 37 and proceeds to synthesize the musical sound waveform of the body (Body3). The specified body vector data of the subsequent sound 45 includes a plurality of loop waveforms "f3", "f4," "f5," "f6," "f7," "f8," "f9," and "f10" of different tone colors and a transition is made from the head (Head3) to the body (Body3) by cross-fading the loop waveforms "f2" and "f3". The musical sound waveform of the body (Body3) is synthesized by connecting the loop waveforms "f3," "f4," "f5," "f6," "f7," "f8," "f9," and "f10" through cross-fading, so that the synthesis of the musical sound waveform of the body (Body3) progresses while changing its tone color.

Then, at time "t6", the waveform synthesis processor 34 reads tail vector data of the specified vector data number from the vector data storage 37 and then proceeds to synthesize the tail (Tail3). The tail vector data of the specified vector data number represents a release of the subsequent sound 45 and includes a one-shot waveform "f12" and a loop waveform "f11" connected to the head end of the one-shot waveform "f12". A transition is made from the body (Body3) to the tail (Tail3) by cross-fading the loop waveforms "f10" and "f11". When the synthesis of the musical sound waveform of the tail (Tail3) is completed, the synthesis of the musical sound waveforms of the previous sound 43, the mis-touching sound 44, and the subsequent sound 45 is completed.

As shown in FIG. 7*b*, since the non-joint articulation process is performed when the subsequent sound 45 overlaps the mis-touching sound 44, the musical sound waveform of the subsequent sound 45 is synthesized through a new synthesis channel, starting from the time "t4" when the note-on event of the subsequent sound 45 occurs, thereby preventing delay in the generation of the subsequent sound 45 due to the presence of the mis-touching sound 44.

Figure 8:
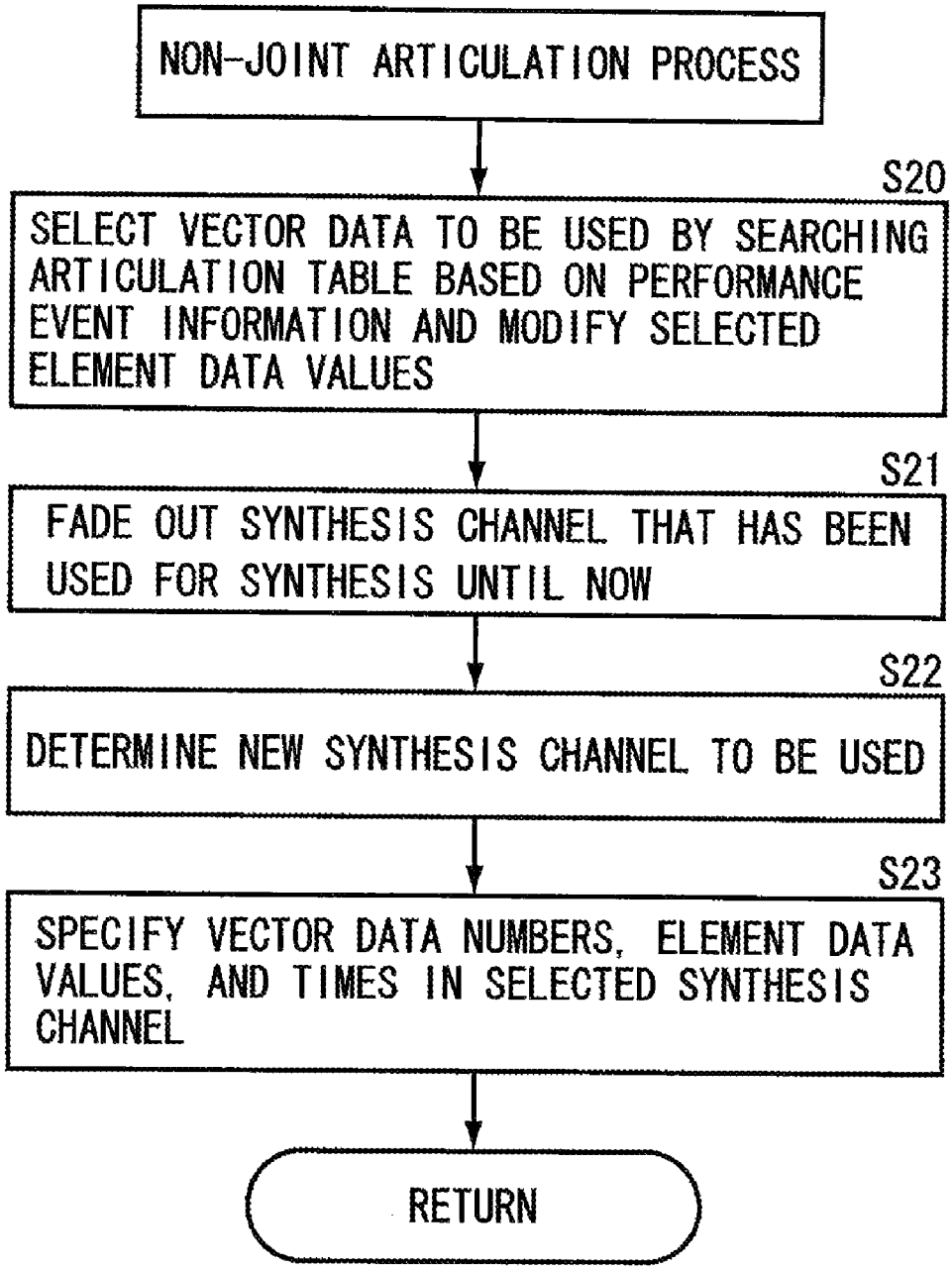
FIG. 8 is another example flow chart of a non-joint articulation process performed in a performance synthesis processor (articulator) in the musical sound waveform synthesizer according to the present invention.

FIG. 8 is another example flow chart of how the performance synthesis processor (articulator) 33 performs a non-joint articulation process when it has been determined that synthesis is to be performed using a non-joint articulation.

When the non-joint articulation process shown in FIG. 8 is activated, vector data of waveform data parts to be used is selected by searching the articulation table 36 based on performance event information and element data (or data of elements) included in the selected vector data is modified based on the performance event information at step S20. Then, at step S21, an instruction to fade out and terminate a musical sound waveform that is in process of being synthesized through a synthesis channel that has been used until now is issued to the waveform synthesis processor 34. Then, at step S22, the performance synthesis processor 33 selects (or determines) a new synthesis channel to be used to synthesize a musical sound waveform for the received note-on event. Then, at step S23, the performance synthesis processor 33 prepares for synthesis of a musical sound waveform by specifying vector data numbers, element data values, and times of the waveform data parts for the selected synthesis channel. Accordingly, the non-joint articulation process is terminated and then the synthesizer returns to the musical sound waveform synthesis process. In this example of the non-joint articulation process, the musical sound waveform that is in process of being synthesized is terminated by fading it out, so that it sounds like a natural musical sound.

Figure 9:
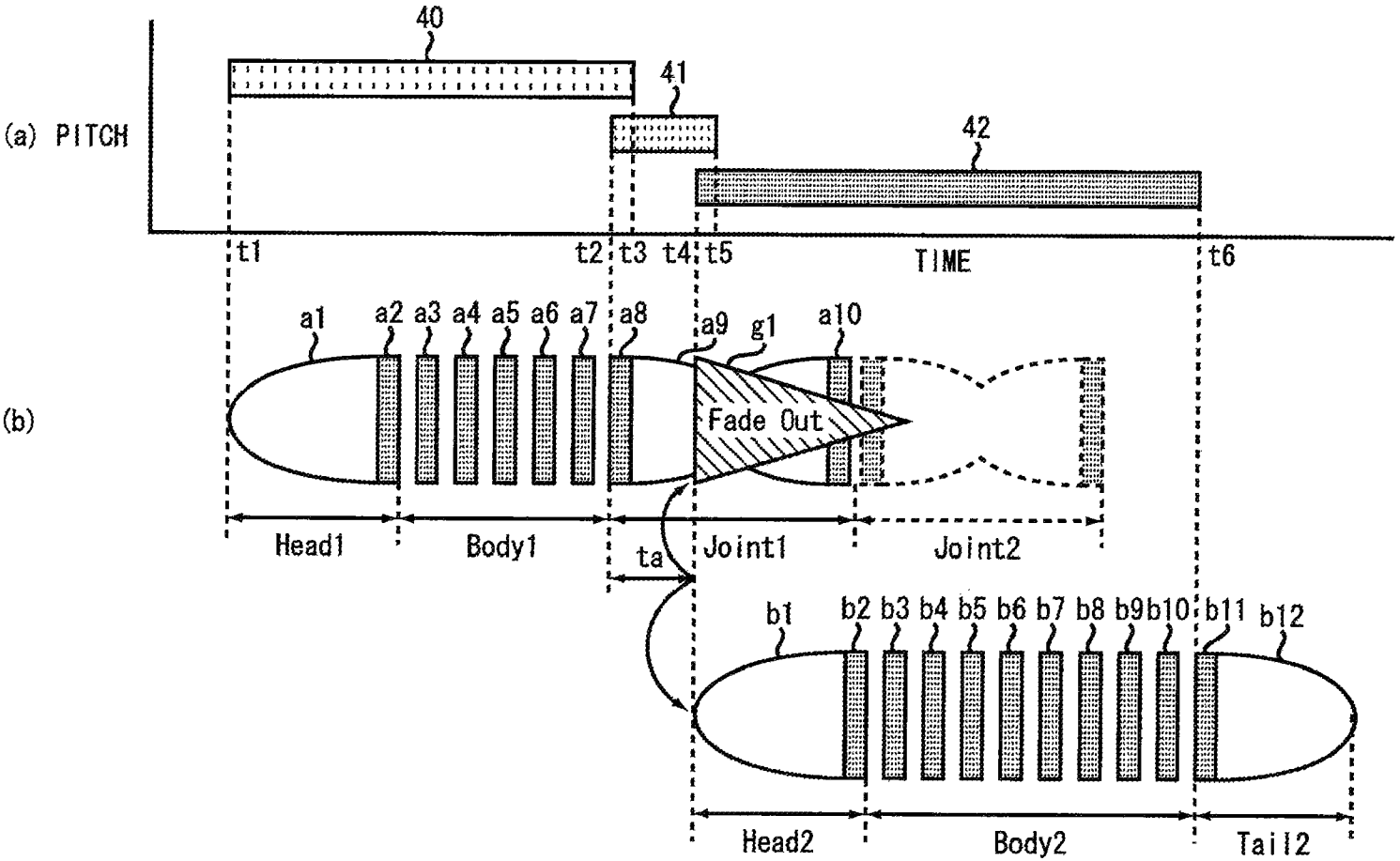
FIGS. 9*a* and 9*b* illustrate another example of a musical sound waveform synthesized in the musical sound waveform synthesizer according to the present invention in contrast with a corresponding music score that is played.
Figure 10:
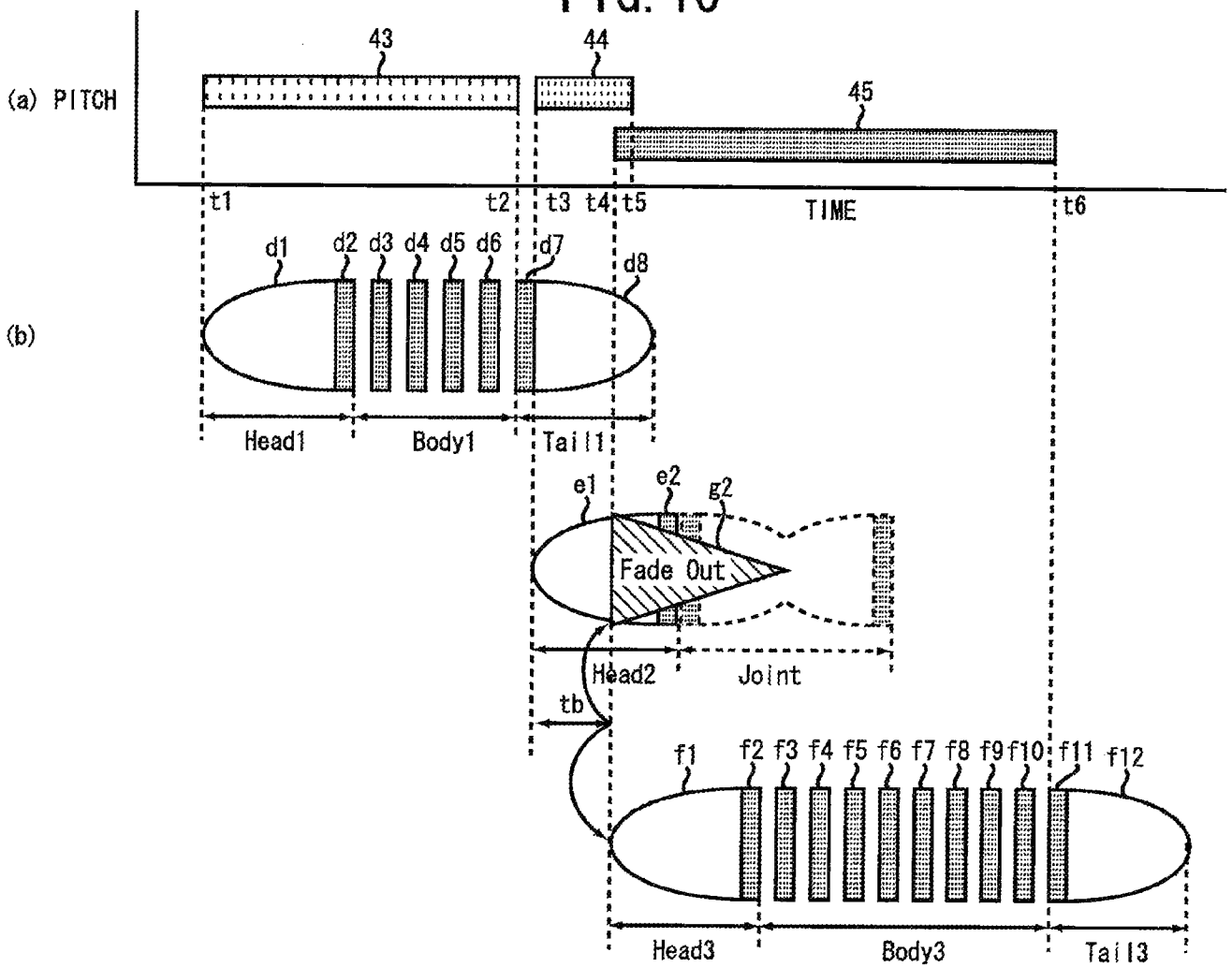
FIGS. 10*a* and 10*b* illustrate another example of a musical sound waveform synthesized in the musical sound waveform synthesizer according to the present invention in contrast with a corresponding music score that is played.
Figure 11:
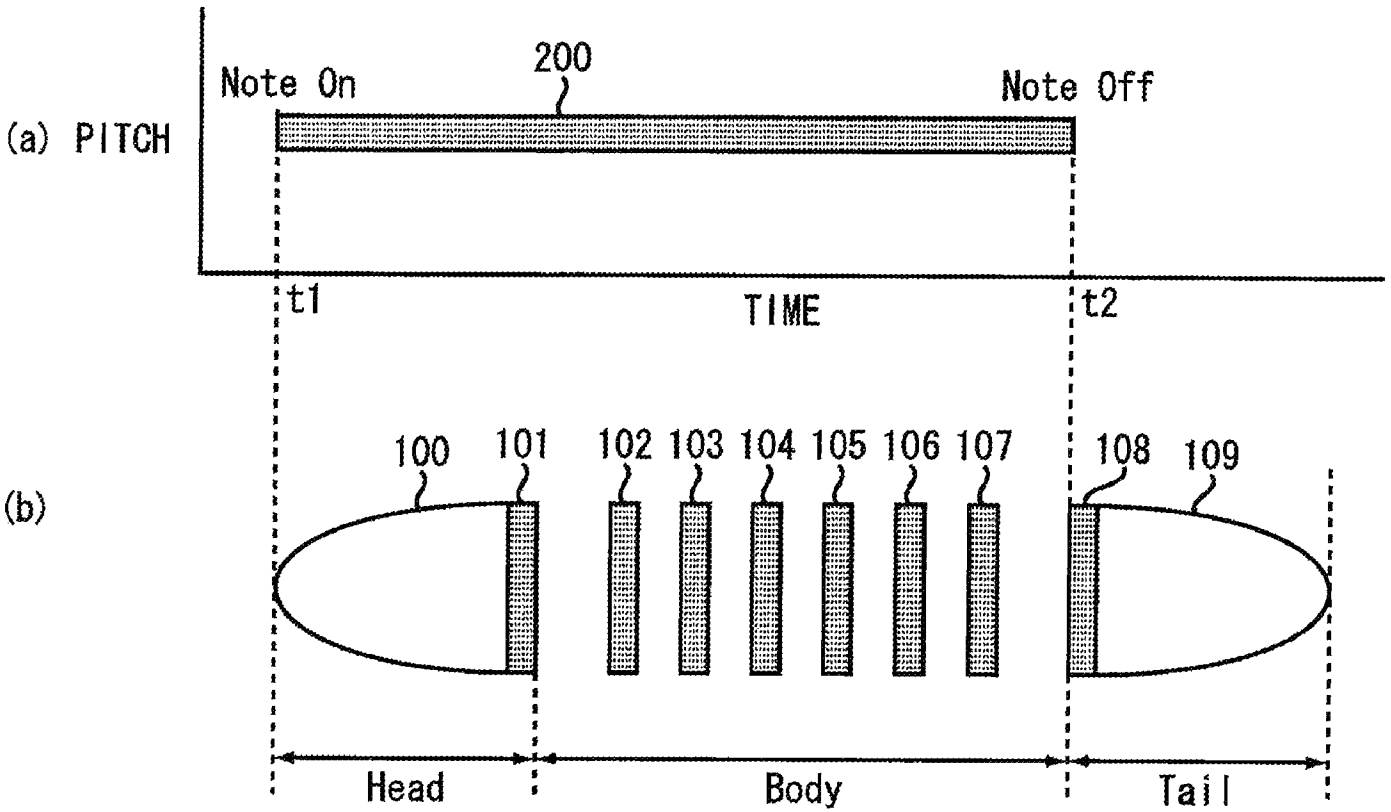
FIG. 11 (PRIOR ART)
FIGS. 11*a* and 11*b* illustrate an example of a musical sound waveform synthesized in a musical sound waveform synthesizer in contrast with a corresponding music score that is played.

With reference to FIGS. 9 and 10, a description will now be given of an example of the synthesis of a musical sound waveform in the waveform synthesis processor 34 when the non-joint articulation process shown in FIG. 8 is performed.

FIG. 9*a* illustrates the same music score written in piano roll notation as shown in FIG. 6*a*, and FIG. 9*b* illustrates a musical sound waveform that is synthesized when the music score is played. The musical sound waveform shown in FIG. 9*b* differs from that shown in FIG. 6*b* only in that the joint (Joint1) is faded out. Thus, the following description will focus on how the joint (Joint1) is faded out. As described above, the synthesizer performs the joint-based articulation process when joining together the previous sound 40 and the mis-touching sound 41 and performs the non-joint-based articulation process shown in FIG. 8 when joining together the mis-touching sound 41 and the subsequent sound 42. Accordingly, it is determined that the musical sound waveform of the previous sound 40 and the mis-touching sound 41 is to be synthesized using a combination of the head (Head1), the body (Body1), and the joint (Joint1), and the musical sound waveform of the subsequent sound 42 is to be synthesized using a combination of the head (Head2), the body (Body2), and the tail (Tail2). In this example, the musical sound waveform of the mis-touching sound 41 is terminated at the joint (Joint1) without synthesizing the joint (Joint2) as described above. However, the musical sound waveform of the mis-touching sound 41 is terminated by fading out the joint (Joint1). Specifically, when the time "t4" is reached, the joint (Joint1) is synthesized while being faded out by controlling the amplitude of the joint (Joint1) according to a fade-out waveform g1. A description of the other features of the waveform synthesis process of the musical sound waveform is omitted since it is similar to that of the waveform synthesis process in FIG. 6*b*.

FIG. 10*a* illustrates the same music score written in piano roll notation as shown in FIG. 7*a*, and FIG. 10*b* illustrates a musical sound waveform that is synthesized when the music score is played. The musical sound waveform shown in FIG. 10*b* differs from that shown in FIG. 7*b* only in that the head (Head2) is faded out. Thus, the following description will focus on how the head (Head2) is faded out. As described above, the synthesizer performs the non-joint-based articulation process shown in FIG. 8 when joining together the mis-touching sound 44 and the subsequent sound 45. Accordingly, it is determined that the musical sound waveform of the mis-touching sound 44 is to be synthesized using the head (Head2) and the musical sound waveform of the subsequent sound 45 is to be synthesized using a combination of the head (Head3), the body (Body3), and the tail (Tail3). In this example, the musical sound waveform of the mis-touching sound 44 is terminated at the head (Head2) without synthesizing a joint as described above. However, the musical sound waveform of the mis-touching sound 44 is terminated by fading out the head (Head2). Specifically, when the time "t4" is reached, the head (Head2) is synthesized while being faded out by controlling the amplitude of the head (Head2) according to a fade-out waveform "g2". A description of the other features of the waveform synthesis process of the musical sound waveform is omitted since it is similar to that of the waveform synthesis process in FIG. 7*b*.

When the non-joint articulation process shown in FIG. 8 is performed, the musical sound waveform that is in process of being synthesized through a channel is terminated by fading it out in the channel, so that the musical sound of the channel sounds like a natural musical sound.

In accordance with a second aspect of the present invention, there is provided a musical sound waveform synthesizer wherein, when a note-on event of a second musical sound that does not overlap a first or previous musical sound is detected, the synthesis of a musical sound waveform of the previous sound instantly terminated and the synthesis of a musical sound waveform corresponding to the note-on event of the second musical sound is initiated if it is determined that the length of a rest between the previous sound and the note-on event does not exceed a predetermined rest length and that the length of the previous sound does not exceed a predetermined sound length.

Figure 16:
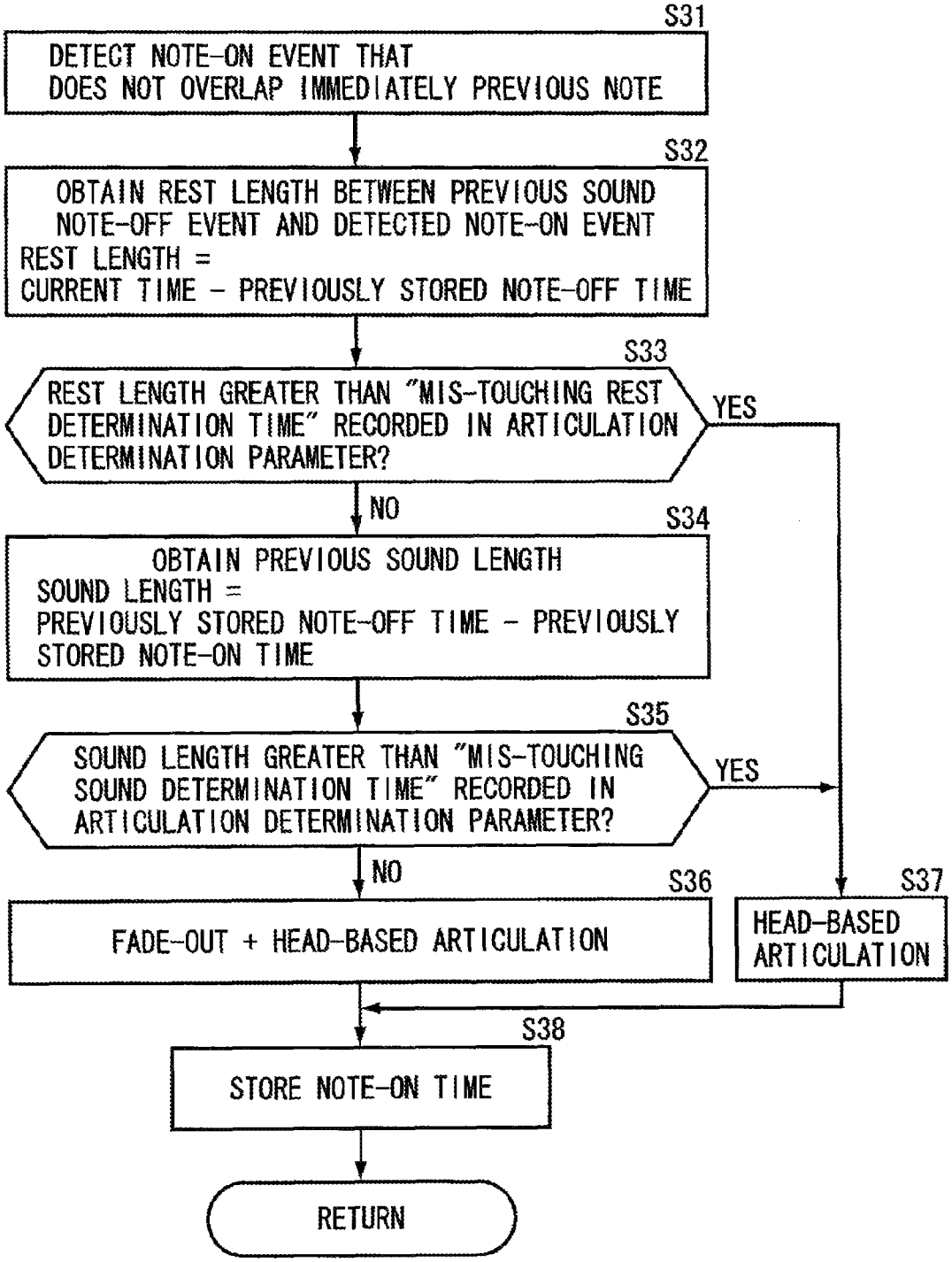
FIG. 16 is a flow chart of an articulation determination process performed in the musical sound waveform synthesizer according to the present invention.

FIG. 16 is a flow chart of a characteristic articulation determination process performed by the articulation analysis processor (player) 32 in the musical sound waveform synthesizer 1 according to the second aspect of the present invention.

The articulation determination process shown in FIG. 16 is activated when a note-on event is received after a note-off event of a previous sound is received so that it is detected that the note-on event does not overlap the generation of the previous sound (S31). It may be detected that the note-on event does not overlap the generation of the previous sound when the performance (MIDI) reception processor 31 receives the note-on event after passing through a period of time having no note-on events of pitches after receiving the note-off event of the previous sound. When it is detected that the received note-on event does not overlap the generation of the previous sound, the length of a rest (or pause) between the note-off event of the previous sound and the received note-on event is obtained, at step S32, by subtracting a previously stored time (i.e., a previous sound note-off time) when the note-off event of the previous sound was received from the current time. Then, it is determined at step S33 whether or not the obtained length of the rest is greater than a "mis-touching rest determination time" that has been stored as an articulation determination time parameter. When it is determined that the obtained length of the rest is less than or equal to the mis-touching rest determination time, the process proceeds to step S34 to obtain the length of the previous sound by subtracting a previously stored time (i.e., a previous sound note-on time) when the note-on event of the previous sound was received from another previously stored time (i.e., the previous sound note-off time) when the note-off event of the previous sound was received. Then, it is determined at step S35 whether or not the obtained length of the previous sound is greater than a "mis-touching sound determination time" that has been stored as an articulation determination time parameter. If it is determined that the length of the rest is less than or equal to the mis-touching rest determination time and the length of the previous sound is also less than or equal to the mis-touching sound determination time, it is determined that the previous sound is a mis-touching sound and the process proceeds to step S36. At step S36, it is determined that the articulation is a fade-out head-based articulation which allows the previous sound to be faded out while starting the synthesis of a musical sound waveform from its head in response to the note-on event, and a corresponding articulation process is then performed. Accordingly, when it is determined that the previous sound is a mis-touching sound, the previous sound is faded out, thereby preventing the mis-touching sound from being self-sustained.

If it is determined that the length of the rest is greater than the mis-touching rest determination time or if it is determined that the length of the rest is less than or equal to the mis-touching rest determination time but the length of the previous sound is greater than the mis-touching rest determination time, the process branches to step S37 to determine that the articulation is a head-based articulation which allows the synthesis of the previous sound to be continued while starting the synthesis of a musical sound waveform from its head in response to the note-on event, and a corresponding articulation process is then performed. Accordingly, when it is determined that the previous sound is not a mis-touching sound, the synthesis of the previous sound is continued and the synthesis of a musical sound waveform is initiated in response to the note-on event. When the articulation has been determined at step S36 or S37, the time when the note-on event has been inputted is stored and the articulation determination process is terminated, and then the synthesizer returns to the musical sound waveform synthesis process.

Figure 17:
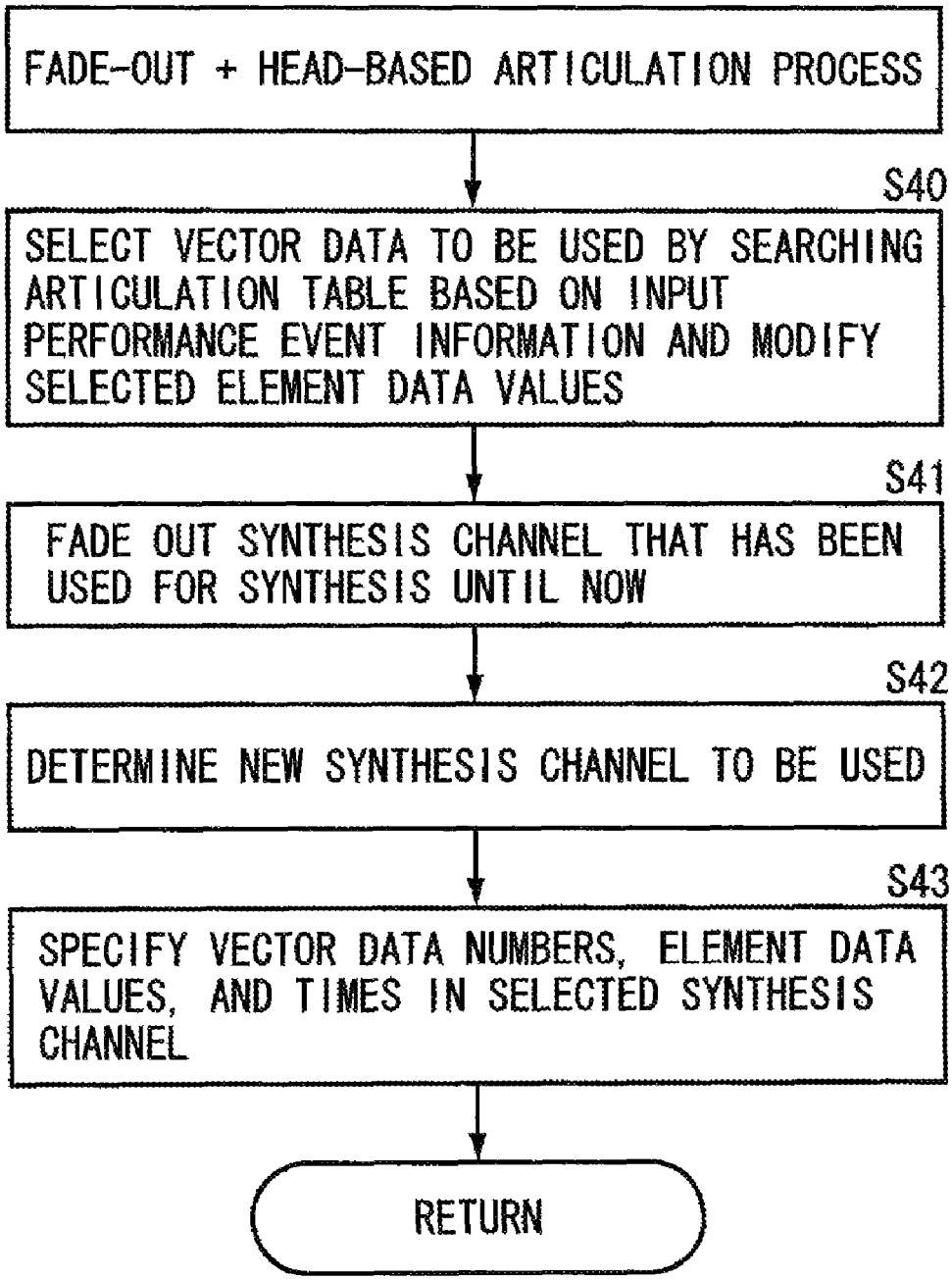
FIG. 17 is an example flow chart of a Head-based articulation process with fade-out performed in a performance synthesis processor (articulator) in the musical sound waveform synthesizer according to the present invention.

FIG. 17 is a flow chart of how the performance synthesis processor (articulator) 33 performs a fade-out head-based articulation process when it has been determined that a musical sound waveform is to be synthesized using a fade-out head-based articulation.

When the fade-out head-based articulation process is activated, vector data of waveform data parts to be used is selected by searching the articulation table 36 based on performance event information and element data (or data of elements) included in the selected vector data is modified based on the performance event information at step S40. The element data includes waveform (or timbre) elements, pitch elements, and amplitude elements of harmonic components and waveform (or timbre) elements and amplitude elements of non-harmonic components. The waveform data parts are formed using the vector data including these elements. The element data can vary with time.

Then, at step S41, an instruction to fade out and terminate a musical sound waveform that is in process of being synthesized through a synthesis channel that has been used until now is issued to the waveform synthesis processor 34. Accordingly, the musical sound waveform of the previous sound sounds like a natural musical sound even when, upon receiving the instruction, the waveform synthesis processor 34 terminates the musical sound waveform of the previous sound during the synthesis of its waveform data part. The performance synthesis processor 33 and the waveform synthesis processor 34 are operated by multitasking of the CPU 10, so that the performance synthesis processor 33 proceeds to the next step S42 while the waveform synthesis processor 34 is in process of terminating the synthesis. Then, at step S42, the performance synthesis processor 33 determines a new synthesis channel to be used to synthesize a musical sound waveform for the received note-on event. Then, at step S43, the performance synthesis processor 33 prepares for synthesis of a musical sound waveform by specifying vector data numbers, element data values, and times of the selected waveform data parts to be used for the determined synthesis channel. Accordingly, the fade-out head-based articulation process is terminated and then the synthesizer returns to the musical sound waveform synthesis process, so that the synthesis through the synthesis channel that has been used until now is terminated and the musical sound waveform for the received note-on event is synthesized through the determined synthesis channel.

A description will now be given of an example in which the articulation analysis processor (player) 32 performs an articulation determination process, including the articulation determination process shown in FIG. 16, to determine an articulation and thus to determine waveform data parts used to synthesize a musical sound waveform and the articulation synthesis processor (articulator) 33 and the waveform synthesis processor 34 synthesize the musical sound waveform. In this example, the articulation determination process shown in FIG. 16 is performed to determine whether the corresponding articulation is a head-based articulation or a fade-out head-based articulation.

Figure 18:
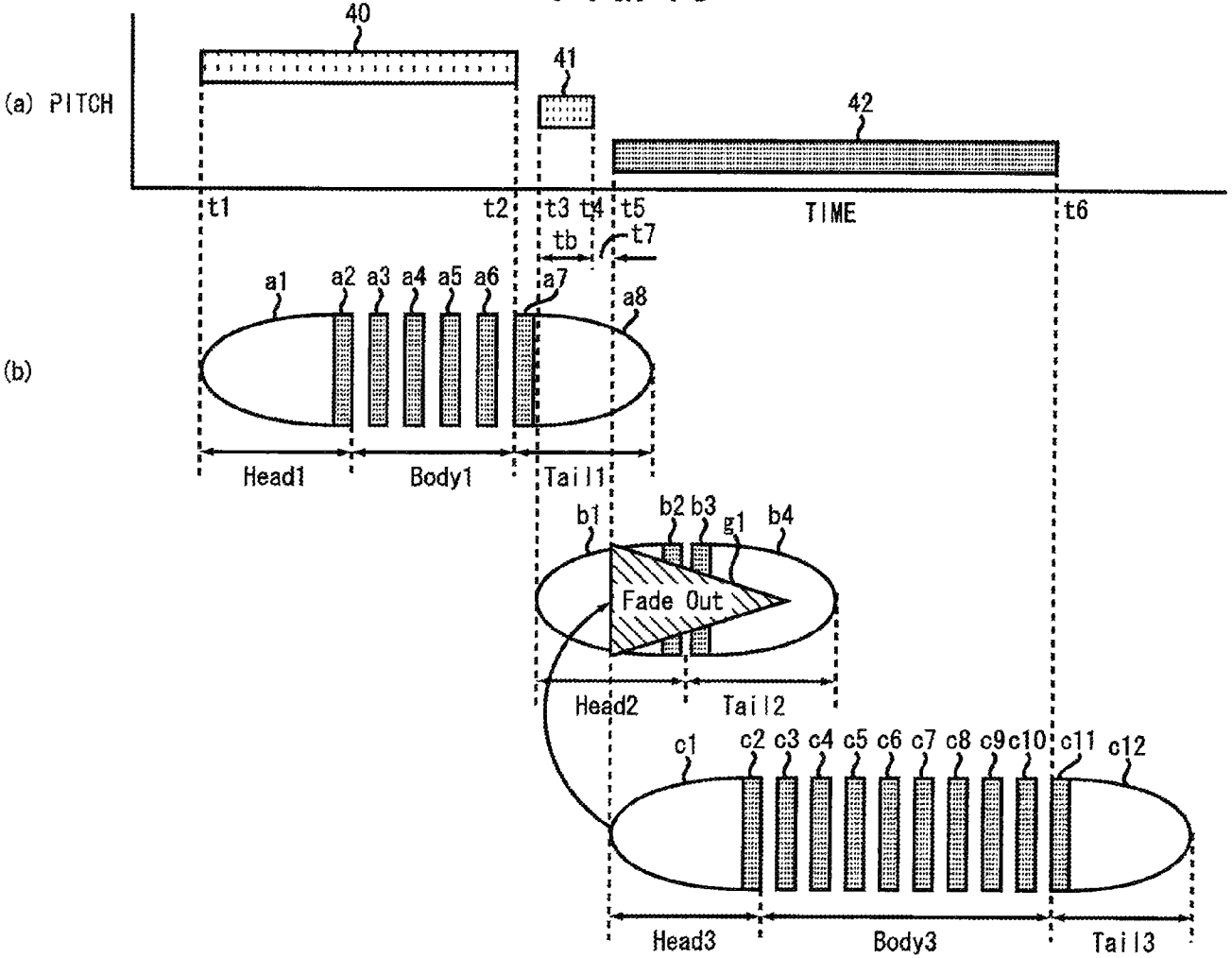
FIGS. 18*a* and 18*b* illustrate an example of a musical sound waveform synthesized in the musical sound waveform synthesizer according to the present invention in contrast with a corresponding music score that is played.

FIGS. 18*a* and 18*b* illustrate an example of the synthesis of a musical sound waveform in the musical sound waveform synthesizer 1 when a first example of a performance event including a short sound produced by mis-touching is received.

When the keyboard/controller 30 in the operator 13 is operated to play a music score written in piano roll notation shown in FIG. 18*a*, which includes the short sound produced by mis-touching, a note-on event of a previous sound 40 occurs at time "t1" and is then received by the musical sound waveform synthesizer. Here, the articulation determination process shown in FIG. 16 is not activated and the articulation is determined to be a head-based articulation since no performance event occurs before the previous sound 40. Accordingly, the musical sound waveform synthesizer starts synthesizing a musical sound waveform of the previous sound 40 from its head (Head1) at time "t1" as shown in FIG. 18*b*. Upon completing the synthesis of the head (Head1), the musical sound waveform synthesizer still proceeds to synthesize the musical sound waveform while transitioning it from the head (Head1) to a body (Body1) since it has not received any note-off event as shown in FIG. 18*b*. Upon receiving a note-off event of the previous sound 40 at time "t2", the musical sound waveform synthesizer synthesizes the musical sound waveform while transitioning it from the body (Body1) to a tail (Tail1). Upon completing the synthesis of the tail (Tail1), the musical sound waveform synthesizer completes the synthesis of the musical sound waveform of the previous sound 40.

Then, upon receiving a note-on event of a short sound 41 at time "t3", the musical sound waveform synthesizer activates the articulation determination process shown in FIG. 16 since it has received the note-on event after receiving the note-off event of the previous sound 40. In the articulation determination process, the length of a rest between the previous sound 40 and the short sound 41 is obtained by subtracting the time "t2" from the time "t3" and the obtained length of the rest is contrasted with a "mis-touching rest determination time" parameter in the articulation determination parameters. In this example, it is determined that the obtained length of the rest is less than or equal to the mis-touching rest determination time. In addition, the length of the previous sound 40 is obtained by subtracting the time "to" when the note-on event of the previous sound 40 was received from the time "t2" when the note-off event of the previous sound 40 was received, and the obtained length of the previous sound 40 is contrasted with the mis-touching sound determination time in the articulation determination parameters. In this example, it is determined that the previous sound 40 is long so that the length of the previous sound 40 is greater than that of the mis-touching sound determination time, and thus the articulation is determined to be a head-based articulation. That is, it is determined that the previous sound 40 is not a mis-touching sound. Accordingly, the musical sound waveform synthesizer 1 starts synthesizing a musical sound waveform of the short sound 41 from its head (Head2) at time "t3" as shown in FIG. 18*b*. A note-off event of the short sound 41 occurs at time "t4" before the synthesis of the head (Head2) is terminated and is then received by the musical sound waveform synthesizer. Accordingly, upon completing the synthesis of the head (Head2), the synthesizer proceeds to synthesize the musical sound waveform while transitioning it from the head (Head2) to a tail (Tail2).

Then, upon receiving a note-on event of a subsequent sound at time "t5", the musical sound waveform synthesizer activates the articulation determination process shown in FIG. 16 since it has received the note-on event after receiving the note-off event of the short sound 41. In the articulation determination process, the length "ta" of a rest between the short sound 41 and the subsequent sound 42 is obtained by subtracting the time "t4" from the time "t5" and the obtained rest length "ta" is contrasted with the "mis-touching rest determination time" parameter in the articulation determination parameters. In this example, it is determined that the obtained rest length "ta" is less than or equal to the mis-touching rest determination time. In addition, the length "tb" of the short sound 41 is obtained by subtracting the time "t3" when the note-on event of the short sound 41 was received from the time "t4" when the note-off event of the short sound 41 was received, and the obtained short sound length "tb" is contrasted with the mis-touching sound determination time in the articulation determination parameters. In this example, it is determined that the short sound 41 is short so that the length "tb" of the short sound 41 is less than or equal to that of the mis-touching sound determination time, and thus the articulation is determined to be a fade-out head-based articulation. That is, it is determined that the short sound 41 is a mis-touching sound. Accordingly, the musical sound waveform synthesizer performs the fade-out head-based articulation process shown in FIG. 17 to synthesize the musical sound waveform of the short sound 41 while controlling the amplitude of the musical sound waveform according to a fade-out waveform "g1", starting from the time "t5" when the note-on event of the subsequent sound 42 is received. At time "t5", the musical sound waveform synthesizer starts synthesizing a musical sound waveform of the subsequent sound 42 from its head (Head3) through a new synthesis channel as shown in FIG. 18*b*. Upon completing the synthesis of the head (Head3), the musical sound waveform synthesizer still proceeds to synthesize the musical sound waveform while transitioning it from the head (Head3) to a body (Body3) since it has not received any note-off event of the subsequent sound 42 as shown in FIG. 18*b*. Then, at time "t6", the synthesizer receives a note-off event of the subsequent sound 42 and proceeds to synthesize the musical sound waveform while transitioning it from the body (Body3) to a tail (Tail3). The synthesizer then completes the synthesis of the tail (Tail3), thereby completing the synthesis of the musical sound waveform of the subsequent sound 42.

In this manner, the musical sound waveform synthesizer performs the head-based articulation process when receiving the note-on events of the previous sound 40 and the short sound 41 and performs the fade-out head-based articulation process shown in FIG. 17 when receiving the note-on event of the subsequent sound 42. Accordingly, the synthesizer synthesizes the musical sound waveform of the previous sound 40 using the head (Head1), the body (Body1), and the tail (Tail1), and synthesizes the musical sound waveform of the short sound 41 using the head (Head2) and the tail (Tail2). However, the synthesizer fades out the musical sound waveform of the short sound 41 according to the fade-out waveform "g1", starting from a certain time during the synthesis of the musical sound waveform thereof. In addition, the synthesizer synthesizes the musical sound waveform of the subsequent sound 42 using the head (Head3), the body (Body3), and the tail (Tail3).

Accordingly, when a performance is played as shown in FIG. 18*a*, a musical sound waveform is synthesized as shown in FIG. 18*b*. Specifically, the waveform synthesis processor 34 reads head vector data of the specified vector data number at the time "t1" in a first synthesis channel from the vector data storage 37 and then proceeds to synthesize the head (Head1). This head vector data includes a one-shot waveform a1 representing an attack of the previous sound 40 and a loop waveform "a2" connected to the tail end of the one-shot waveform "a1". Upon completing the synthesis of the musical sound waveform of the head (Head1), the waveform synthesis processor 34 reads body vector data of the specified vector data number from the vector data storage 37 and proceeds to synthesize the musical sound waveform of the body (Body1). The specified body vector data of the previous sound 40 includes a plurality of loop waveforms "a3," "a4," "a5," and "a6" of different tone colors and a transition is made from the head (Head1) to the body (Body1) by cross-fading the loop waveforms "a2" and "a3". The musical sound waveform of the body (Body1) is synthesized by connecting the loop waveforms "a3," "a4," "a5," and "a6" through cross-fading, so that the synthesis of the musical sound waveform of the body (Body1) progresses while changing its tone color. Then, at time "t2", the waveform synthesis processor 34 reads tail vector data of the specified vector data number from the vector data storage 37 and then proceeds to synthesize the tail (Tail1). The tail vector data of the specified vector data number represents a release of the previous sound 40 and includes a one-shot waveform "a8" and a loop waveform "a7" connected to the head end of the one-shot waveform "a8". A transition is made from the body (Body1) to the tail (Tail1) by cross-fading the loop waveforms "a6" and "a7". By completing the synthesis of the musical sound waveform of the tail (Tail1), the synthesizer completes the synthesis of the musical sound waveform of the previous sound 40.

At time "t3", the waveform synthesis processor 34 reads head vector data of the specified vector data number in a second synthesis channel from the vector data storage 37 and then proceeds to synthesize the head (Head2). This head vector data includes a one-shot waveform b1 representing an attack of the short sound 41 and a loop waveform "b2" connected to the tail end of the one-shot waveform "b1". Since the synthesis of the musical sound waveform of the head (Head2) is completed after the time "t4" when the note-off event of the short sound 41 is received, the waveform synthesis processor 34 reads tail vector data of the specified vector data number from the vector data storage 37 and then proceeds to synthesize the tail (Tail2). This specified tail vector data represents a release of the short sound 41 and includes a one-shot waveform "b4" and a loop waveform "b3" connected to the head end of the one-shot waveform "b4". A transition is made from the head (Head2) to the tail (Tail2) by cross-fading the loop waveforms "b2" and "b3". However, as described above, the musical sound waveform of the head (Head2) and the tail (Tail2) is faded out by multiplying it by the amplitude of the fade-out waveform "g1," starting from the time "t5". By completing the synthesis of the musical sound waveform of the tail (Tail2), the synthesizer completes the synthesis of the musical sound waveform of the short sound 41 through the second synthesis channel. Here, the synthesizer may terminate the synthesis of the musical sound waveform when the amplitude of the musical sound waveform approaches zero as it is faded out according to the fade-out waveform "g1".

At time "t5", the waveform synthesis processor 34 also reads head vector data of a specified vector data number at time "t5" in a third synthesis channel from the vector data storage 37 and then proceeds to synthesize the head (Head3). This head vector data includes a one-shot waveform "c1" representing an attack of the subsequent sound 42 and a loop waveform "c2" connected to the tail end of the one-shot waveform "c1". Upon completing the synthesis of the musical sound waveform of the head (Head3), the waveform synthesis processor 34 reads body vector data of the specified vector data number from the vector data storage 37 and proceeds to synthesize the musical sound waveform of the body (Body3). The specified body vector data of the subsequent sound 42 includes a plurality of loop waveforms "c3," "c4," "c5," "c6," "c7," "c8," "c9," and "c10" of different tone colors and a transition is made from the head (Head3) to the body (Body3) by cross-fading the loop waveforms "c2" and "c3". The musical sound waveform of the body (Body3) is synthesized by connecting the loop waveforms "c3," "c4," "c5," "c6," "c7," "c8," "c9," and "c10" through cross-fading, so that the synthesis of the musical sound waveform of the body (Body3) progresses while changing its tone color.

Then, at time "t6", the waveform synthesis processor 34 reads tail vector data of the specified vector data number from the vector data storage 37 and then proceeds to synthesize the tail (Tail3). The specified tail vector data represents a release of the subsequent sound 42 and includes a one-shot waveform "c12" and a loop waveform "c11" connected to the head end of the one-shot waveform "c12". A transition is made from the body (Body3) to the tail (Tail3) by cross-fading the loop waveforms "c10" and c11. When the synthesis of the musical sound waveform of the tail (Tail3) is completed, the synthesis of the musical sound waveforms of the previous sound 40, the short sound 41, and the subsequent sound 42 is completed.

As described above, the fade-out head-based articulation process shown in FIG. 17 is performed when the note-on event of the subsequent sound 42 is received, so that the musical sound waveform of the short sound 41 is faded out according to the fade-out waveform "g1," starting from the time "t5" when the note-on event of the subsequent sound 42 is received, as shown in FIG. 18*b*. Accordingly, the short sound 41, which has been determined to be a mis-touching sound, is not self-sustained.

Figure 19:
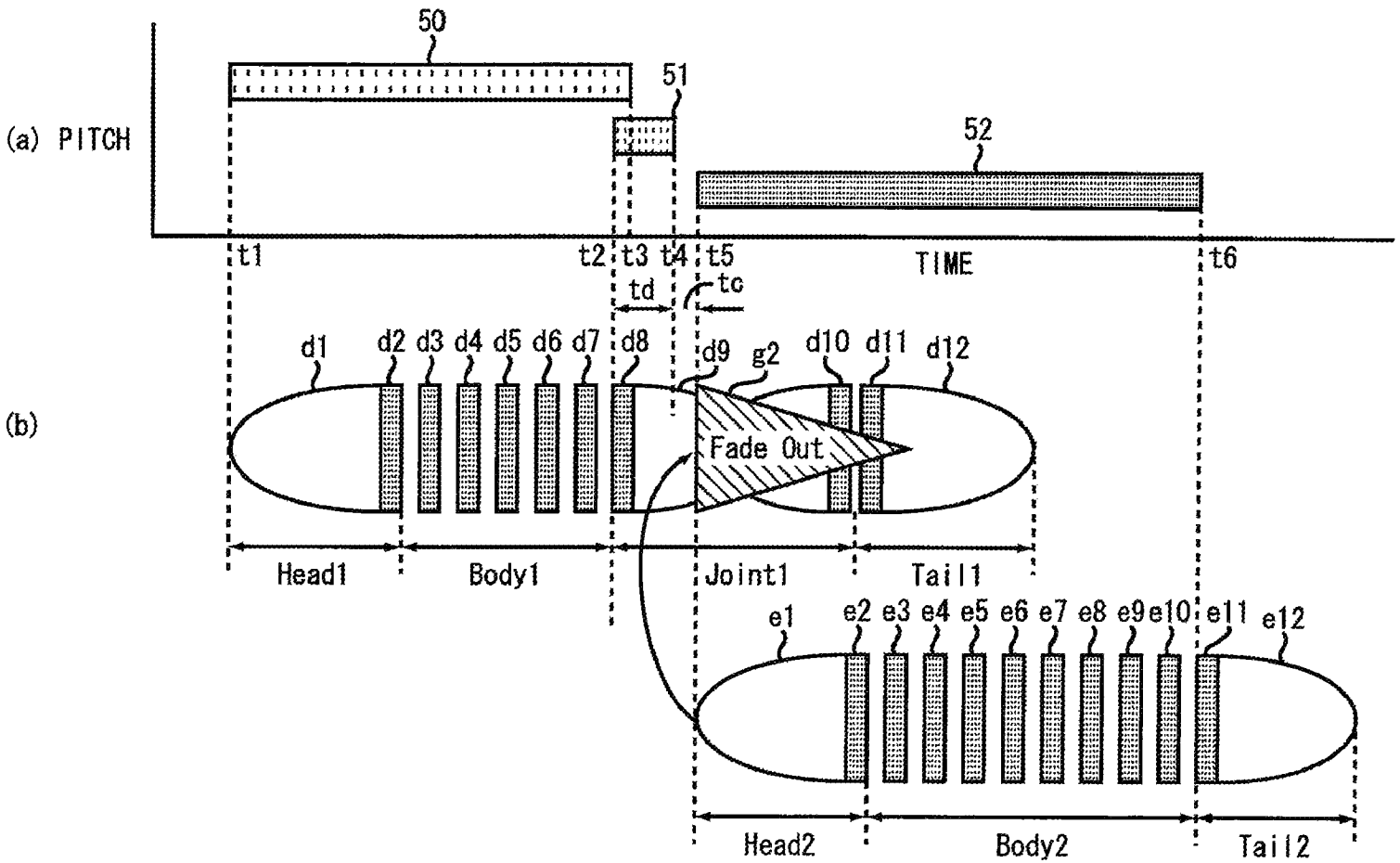
FIGS. 19*a* and 19*b* illustrate another example of a musical sound waveform synthesized in the musical sound waveform synthesizer according to the present invention in contrast with a corresponding music score that is played.

FIGS. 19*a* and 19*b* illustrate an example of the synthesis of a musical sound waveform in the musical sound waveform synthesizer 1 when a second example of a performance event including a short sound produced by mis-touching is received.

When the keyboard/controller 30 in the operator 13 is operated to play a music score written in piano roll notation shown in FIG. 19*a*, which includes the short sound produced by mis-touching, a note-on event of a previous sound 50 occurs at time "t1" and is then received by the musical sound waveform synthesizer. Here, the articulation determination process shown in FIG. 16 is not activated and the articulation is determined to be a head-based articulation since no performance event occurs before the previous sound 50. Accordingly, the musical sound waveform synthesizer starts synthesizing a musical sound waveform of the previous sound 50 from its head (Head1) at time "t1" as shown in FIG. 19*b*. Upon completing the synthesis of the head (Head1), the musical sound waveform synthesizer still proceeds to synthesize the musical sound waveform while transitioning it from the head (Head1) to a body (Body1) since it has not received any note-off event as shown in FIG. 19*b*. When it receives a note-on event of a short sound 51 at time "t2", the musical sound waveform synthesizer determines that the short sound 51 overlaps the previous sound 50 since it still has not received any note-off event of the previous sound 50. Accordingly, the synthesizer performs a joint-based articulation using a joint and proceeds to synthesize the musical sound waveform while transitioning it from the body (Body1) to a joint (Joint1) representing a pitch transition part from the previous sound 50 to the short sound 51. Then, the synthesizer receives a note-off event of the previous sound 50 at time "t3" before completing the synthesis of the joint (Joint1) and subsequently receives a note-off event of the short sound 51 at time "t4". Accordingly, upon completing the synthesis of the joint (Joint1), the synthesizer proceeds to synthesize the musical sound waveform while transitioning it from the joint (Joint1) to a tail (Tail1).

Then, upon receiving a note-on event of a subsequent sound 52 at time "t5" immediately after time "t4", the musical sound waveform synthesizer activates the articulation determination process shown in FIG. 16 since it has received the note-on event after receiving the note-off event of the short sound 51. In the articulation determination process, the length "tc" of a rest between the short sound 51 and the subsequent sound 52 is obtained by subtracting the time "t4" from the time "t5" and the obtained rest length "tc" is contrasted with the "mis-touching rest determination time" parameter in the articulation determination parameters. In this example, it is determined that the obtained rest length "tc" is less than or equal to the mis-touching rest determination time. In addition, the length "td" of the short sound 41 is obtained by subtracting the time "t3" when the note-on event of the short sound 51 was received from the time "t4" when the note-off event of the short sound 51 was received, and the obtained short sound length "td" is contrasted with the mis-touching sound determination time in the articulation determination parameters. In this example, it is determined that the short sound 51 is short so that the length "td" of the short sound 51 is less than or equal to that of the mis-touching sound determination time, and thus the articulation is determined to be a fade-out head-based articulation. That is, it is determined that the short sound 51 is a mis-touching sound. Accordingly, the musical sound waveform synthesizer performs the fade-out head-based articulation process shown in FIG. 17 to control the amplitude of the musical sound waveform of the short sound 51 according to a fade-out waveform "g2," starting from the time "t5" when the synthesis of the joint (Joint1) is in process. At time "t5", the musical sound waveform synthesizer starts synthesizing a musical sound waveform of the subsequent sound 52 from its head (Head2) through a new synthesis channel as shown in FIG. 19*b*. Upon completing the synthesis of the head (Head2), the musical sound waveform synthesizer still proceeds to synthesize the musical sound waveform while transitioning it from the head (Head2) to a body (Body2) since it has not received any note-off event of the subsequent sound 52 as shown in FIG. 19*b*. Then, at time "t6", the synthesizer receives a note-off event of the subsequent sound 52 and proceeds to synthesize the musical sound waveform while transitioning it from the body (Body2) to a tail (Tail2). The synthesizer then completes the synthesis of the tail (Tail2), thereby completing the synthesis of the musical sound waveform of the subsequent sound 52.

In this manner, the musical sound waveform synthesizer performs the head-based articulation process when receiving the note-on event of the previous sound 50, performs the joint-based articulation process when receiving the note-on event of the short sound 51, and performs the fade-out head-based articulation process shown in FIG. 17 when receiving the note-on event of the subsequent sound 52. Accordingly, the synthesizer synthesizes the musical sound waveform of the previous sound 50 and the short sound 51 using the head (Head1), the body (Body1), the joint (Joint1), and the tail (Tail1). However, the synthesizer fades out the musical sound waveform of the joint (Joint1) and the tail (Tail1) according to the fade-out waveform "g2," starting from a certain time during the synthesis of the musical sound waveform thereof. In addition, the synthesizer synthesizes the musical sound waveform of the subsequent sound 52 using the head (Head2), the body (Body2), and the tail (Tail2).

Accordingly, when a performance is played as shown in FIG. 19*a*, a musical sound waveform is synthesized as shown in FIG. 19*b*. Specifically, the waveform synthesis processor 34 reads head vector data of the specified vector data number at the time "t1" in a first synthesis channel from the vector data storage 37 and then proceeds to synthesize the head (Head1). This head vector data includes a one-shot waveform "d1" representing an attack of the previous sound 50 and a loop waveform "d2" connected to the tail end of the one-shot waveform "d1". Upon completing the synthesis of the musical sound waveform of the head (Head1), the waveform synthesis processor 34 reads body vector data of the specified vector data number from the vector data storage 37 and proceeds to synthesize the musical sound waveform of the body (Body1). The specified body vector data of the previous sound 50 includes a plurality of loop waveforms "d3," "d4," "d5," "d6," and "d7" of different tone colors and a transition is made from the head (Head1) to the body (Body1) by cross-fading the loop waveforms "d2" and "d3". The musical sound waveform of the body (Body1) is synthesized by connecting the loop waveforms "d3," "d4," "d5," "d6," and "d7" through cross-fading, so that the synthesis of the musical sound waveform of the body (Body1) progresses while changing its tone color.

Then, at time "t2", the waveform synthesis processor 34 reads joint vector data of the specified vector data number from the vector data storage 37 and then proceeds to synthesize the joint (Joint1). The specified joint vector data represents a pitch transition part from the previous sound 50 to the short sound 51 and includes a one-shot waveform "d9," a loop waveform "d8" connected to the head end of the one-shot waveform "d9," and a loop waveform d10 connected to the tail end thereof. A transition is made from the body (Body1) to the joint (Joint1) by cross-fading the loop waveforms "d7" and "d8". As the synthesis of the joint (Joint1) progresses, a transition is made from the musical sound waveform of the previous sound 50 to that of the short sound 51. When the synthesis of the musical sound waveform of the joint (Joint1) is completed, a transition is made to the tail (Tail1). The tail (Tail1) represents a release of the short sound 51 and includes a one-shot waveform "d12" and a loop waveform "d11" connected to the head end of the one-shot waveform "d12". A transition is made from the joint (Joint1) to the tail (Tail1) by cross-fading the loop waveforms "d10" and "d11". However, as described above, the musical sound waveform of the joint (Joint1) and the tail (Tail1) is faded out by multiplying it by the amplitude of the fade-out waveform "g2," starting from the time "t5". By completing the synthesis of the musical sound waveform of the tail (Tail1), the synthesizer completes the synthesis of the musical sound waveform of the previous sound 50 and the short sound 51. Here, the synthesizer may terminate the synthesis of the musical sound waveform when the amplitude of the musical sound waveform approaches zero as it is faded out according to the fade-out waveform "g2".

At time "t5", the waveform synthesis processor 34 also reads head vector data of a specified vector data number at time "t5" in a second synthesis channel from the vector data storage 37 and then proceeds to synthesize the head (Head2). This head vector data includes a one-shot waveform e1 representing an attack of the subsequent sound 52 and a loop waveform "e2" connected to the tail end of the one-shot waveform e1. Upon completing the synthesis of the musical sound waveform of the head (Head2), the waveform synthesis processor 34 reads body vector data of the specified vector data number from the vector data storage 37 and proceeds to synthesize the musical sound waveform of the body (Body2). The specified body vector data of the subsequent sound 52 includes a plurality of loop waveforms "e3," "e4," "e5," "e6," "e7," "e8," "e9," and "e10" of different tone colors and a transition is made from the head (Head2) to the body (Body2) by cross-fading the loop waveforms "e2" and "e3". The musical sound waveform of the body (Body2) is synthesized by connecting the loop waveforms "e3," "e4," "e5," "e6," "e7," "e8," "e9," and "e10" through cross-fading, so that the synthesis of the musical sound waveform of the body (Body2) progresses while changing its tone color.

Then, at time "t6", the waveform synthesis processor 34 reads tail vector data of the specified vector data number from the vector data storage 37 and then proceeds to synthesize the tail (Tail2). The specified tail vector data represents a release of the subsequent sound 52 and includes a one-shot waveform "e12" and a loop waveform "e11" connected to the head end of the one-shot waveform "e12". A transition is made from the body (Body2) to the tail (Tail2) by cross-fading the loop waveforms "e10" and "e11". When the synthesis of the musical sound waveform of the tail (Tail2) is completed, the synthesis of the musical sound waveforms of the previous sound 50, the short sound 51, and the subsequent sound 52 is completed.

As described above, the fade-out head-based articulation process shown in FIG. 17 is performed when the note-on event of the subsequent sound 52 is received, so that the musical sound waveform of the short sound 51 is faded out according to the fade-out waveform "g2," starting from the time "t5" when the note-on event of the subsequent sound 52 is received, as shown in FIG. 19*b*. Accordingly, the short sound 51, which has been determined to be a mis-touching sound, is not self-sustained.

The musical sound waveform synthesizer according to the present invention described above can be applied to an electronic musical instrument, which is not limited to a keyboard instrument and includes not only a string or wind instrument but also other types of instruments such as a percussion instrument. In the musical sound waveform synthesizer according to the present invention described above, the musical sound waveform synthesis unit is implemented by running the musical sound waveform program through the CPU. However, the musical sound waveform synthesis unit may be provided in hardware structure. In addition, the musical sound waveform synthesizer according to the present invention can also be applied to an automatic playing device such as a player piano.

In the above description, a loop waveform for connection to another waveform data part is added to each waveform data part in the musical sound waveform synthesizer according to the present invention. However, no loop waveform may be added to waveform data parts. In this case, waveform data parts are connected through cross-fading.

The invention claimed is:

1. A musical sound waveform synthesizer apparatus comprising:

a performance event information receiver that receives performance event information representing musical performance events which successively occur as a musical performance progresses;

a musical sound synthesizer that synthesizes a waveform of a musical sound corresponding to each musical performance event based on the performance event information;

an overlap detector that detects whether or not a first musical sound and a second musical sound to be generated subsequently to the first musical sound overlap with each other based on the performance information; and a sound length meter that obtains a sound length of the first musical sound based on the received performance event information, wherein, when the overlap detector has detected that the first musical sound and the second musical sound overlap with each other, the musical sound synthesizer terminates synthesizing of a waveform of the first musical sound and starts synthesizing of a waveform of the second musical sound if it is determined that the sound length of the first musical sound obtained by the sound length meter does not exceed a predetermined sound length, whereas the musical sound synthesizer performs synthesizing of waveforms of both the first musical sound and the second musical sound so that the second musical sound is joined with the first musical sound if it is determined that the sound length of the first musical sound obtained by the sound length meter exceeds the predetermined sound length.

2. The musical sound waveform synthesizer apparatus according to claim 1, wherein, when the overlap detector has detected that the first musical sound and the second musical sound overlap with each other, the musical sound synthesizer terminates the synthesizing of the waveform of the first musical sound by fading out the first musical sound if it is determined that the sound length of the first musical sound obtained by the sound length meter does not exceed the predetermined sound length.

3. The musical sound waveform synthesizer apparatus according to claim 1, wherein the musical sound synthesizer synthesizes a waveform of a musical sound by combining a plurality of waveform parts including a start waveform part, a sustain waveform part, an end waveform part, and a connection waveform part which is used to join two musical sounds, and wherein when the overlap detector has detected that the first musical sound and the second musical sound overlap with each other and it is determined that the sound length of the first musical sound obtained by the sound length meter does not exceed the predetermined sound length, the musical sound synthesizer starts synthesizing of the waveform of the second musical sound from a start waveform part of the waveform.

4. The musical sound waveform synthesizer apparatus according to claim 1, wherein, when the overlap detector has detected that the first musical sound and the second musical sound overlap with each other, the musical sound synthesizer synthesizes the waveforms of both the first musical sound and the second musical sound using a connection waveform part if it is determined that the sound length of the first musical sound obtained by the sound length meter exceeds the predetermined sound length.

5. A musical sound waveform synthesizer apparatus comprising:

a performance event information receiver that receives performance event information representing musical performance events which include note-on events and note-off events and which successively occur as a musical performance progresses;

a musical sound synthesizer that synthesizes a waveform of a musical sound based on the performance event information;

a detector that detects a note-on event of a second musical sound which does not overlap with a first musical sound, based on the performance event information received by the performance event information receiver;

a rest length meter that obtains a length of a rest between a note-off event of the first musical sound and the note-on event of the second musical sound when the detector has detected that the note-on event of the second musical sound does not overlap with the first musical sound; and a sound length meter that obtains a length of the first musical sound based on the performance event information when the detector has detected the note-on event of the second musical sound which does not overlap with the first musical sound, wherein, when it is determined that the length of the rest obtained by the rest length meter does not exceed a predetermined rest length and it is also determined that the length of the first musical sound obtained by the sound length meter does not exceed a predetermined sound length, the musical sound synthesizer terminates synthesizing of a waveform of the first musical sound without completely synthesizing the first musical sound and starts synthesizing of a waveform of the second musical sound corresponding to the note-on event, wherein, when it is determined that the length of the rest obtained by the rest length meter exceeds the predetermined rest length, the musical sound synthesizer completes the synthesizing of the waveform of the first musical sound and performs the synthesizing of the waveform of the second musical sound corresponding to the note-on event, and wherein, when it is determined that the length of the rest obtained by the rest length meter does not exceeds the predetermined rest length and it is determined that the length of the first musical sound obtained by the sound length meter exceeds the predetermined sound length, the musical sound synthesizer completes the synthesizing of the waveform of the first musical sound and performs the synthesizing of the waveform of the second musical sound corresponding to the note-on event.

6. The musical sound waveform synthesizer apparatus according to claim 5, wherein, when it is determined that the length of the rest obtained by the rest length meter does not exceed the predetermined rest length and it is also determined that the length of the first musical sound obtained by the sound length meter does not exceed the predetermined sound length, the musical sound synthesizer terminates the synthesizing of the waveform of the first musical sound without completely synthesizing the first musical sound by fading out part of the first musical sound.

7. A musical sound waveform synthesizing method comprising:

a performance event information receiving step of receiving performance event information representing musical performance events which successively occur as a musical performance progresses;

a musical sound synthesizing step of synthesizing a waveform of a musical sound corresponding to each musical performance event based on the performance event information;

an overlap detecting step of detecting whether or not a first musical sound and a second musical sound to be generated subsequently to the first musical sound overlap with each other based on the performance information; and a sound length measuring step of obtaining a sound length of the first musical sound based on the received performance event information, wherein, when it is detected that the first musical sound and the second musical sound overlap with each other, the musical sound synthesizing step terminates synthesizing of a waveform of the first musical sound and starts synthesizing of a waveform of the second musical sound if it is determined that the obtained sound length of the first musical sound does not exceed a predetermined sound length, whereas the musical sound synthesizing step performs synthesizing of waveforms of both the first musical sound and the second musical sound so that the second musical sound is joined with the first musical sound if it is determined that the obtained sound length of the first musical sound exceeds the predetermined sound length.

8. A musical sound waveform synthesizing method comprising:

a performance event information receiving step of receiving performance event information representing musical performance events which include note-on events and note-off events and which successively occur as a musical performance progresses;

a musical sound synthesizing step of synthesizing a waveform of a musical sound based on the performance event information;

a detecting step of detecting a note-on event of a second musical sound which does not overlap with a first musical sound, based on the received performance event information;

a rest length measuring step of obtaining a length of a rest between a note-off event of the first musical sound and the note-on event of the second musical sound when it is detected that the note-on event of the second musical sound does not overlap with the first musical sound; and a sound length measuring step of obtaining a length of the first musical sound based on the performance event information when it is detected that the note-on event of the second musical sound does not overlap with the first musical sound, wherein, when it is determined that the obtained length of the rest does not exceed a predetermined rest length and it is also determined that the obtained length of the first musical sound does not exceed a predetermined sound length, the musical sound synthesizing step terminates synthesizing of a waveform of the first musical sound without completely synthesizing the first musical sound and starts synthesizing of a waveform of the second musical sound corresponding to the note-on event, wherein, when it is determined that the obtained length of the rest obtained exceeds the predetermined rest length, the musical sound synthesizing step completes the synthesizing of the waveform of the first musical sound and performs the synthesizing of the waveform of the second musical sound corresponding to the note-on event, and wherein, when it is determined that the length of the rest obtained by the rest length meter does not exceeds the predetermined rest length and it is determined that the length of the first musical sound obtained by the sound length meter exceeds the predetermined sound length, the musical sound synthesizing step completes the synthesizing of the waveform of the first musical sound and performs the synthesizing of the waveform of the second musical sound corresponding to the note-on event.

9. A machine readable medium for use in a musical apparatus having a CPU, the medium containing a program executable by the CPU for causing the musical apparatus to perform a musical sound synthesizing process which comprises:

a performance event information receiving step of receiving performance event information representing musical performance events which successively occur as a musical performance progresses;

a musical sound synthesizing step of synthesizing a waveform of a musical sound corresponding to each musical performance event based on the performance event information;

an overlap detecting step of detecting whether or not a first musical sound and a second musical sound to be generated subsequently to the first musical sound overlap with each other based on the performance information; and a sound length measuring step of obtaining a sound length of the first musical sound based on the received performance event information, wherein, when it is detected that the first musical sound and the second musical sound overlap with each other, the musical sound synthesizing step terminates synthesizing of a waveform of the first musical sound and starts synthesizing of a waveform of the second musical sound if it is determined that the obtained sound length of the first musical sound does not exceed a predetermined sound length, whereas the musical sound synthesizing step performs synthesizing of waveforms of both the first musical sound and the second musical sound so that the second musical sound is joined with the first musical sound if it is determined that the obtained sound length of the first musical sound exceeds the predetermined sound length.

10. A machine readable medium for use in a musical apparatus having a CPU, the medium containing a program executable by the CPU for causing the musical apparatus to perform a musical sound synthesizing process which comprises:

a performance event information receiving step of receiving performance event information representing musical performance events which include note-on events and note-off events and which successively occur as a musical performance progresses;

a musical sound synthesizing step of synthesizing a waveform of a musical sound based on the performance event information:

a detecting step of detecting a note-on event of a second musical sound which does not overlap with a first musical sound, based on the received performance event information;

a rest length measuring step of obtaining a length of a rest between a note-off event of the first musical sound and the note-on event of the second musical sound when it is detected that the note-on event of the second musical sound does not overlap with the first musical sound; and a sound length measuring step of obtaining a length of the first musical sound based on the performance event information when it is detected that the note-on event of the second musical sound does not overlap with the first musical sound, wherein, when it is determined that the obtained length of the rest does not exceed a predetermined rest length and it is also determined that the obtained length of the first musical sound does not exceed a predetermined sound length, the musical sound synthesizing step terminates synthesizing of a waveform of the first musical sound without completely synthesizing the first musical sound and starts synthesizing of a waveform of the second musical sound corresponding to the note-on event, wherein, when it is determined that the obtained length of the rest obtained exceeds the predetermined rest length, the musical sound synthesizing step completes the synthesizing of the waveform of the first musical sound and performs the synthesizing of the waveform of the second musical sound corresponding to the note-on event, and wherein, when it is determined that the length of the rest obtained by the rest length meter does not exceeds the predetermined rest length and it is determined that the length of the first musical sound obtained by the sound length meter exceeds the predetermined sound length, the musical sound synthesizing step completes the synthesizing of the waveform of the first musical sound and performs the synthesizing of the waveform of the second musical sound corresponding to the note-on event.

* * * * *